US011006210B2

(12) United States Patent
Ko et al.

(10) Patent No.: US 11,006,210 B2
(45) Date of Patent: May 11, 2021

(54) APPARATUS AND METHOD FOR OUTPUTTING AUDIO SIGNAL, AND DISPLAY APPARATUS USING THE SAME

(71) Applicant: SAMSUNG ELECTRONICS CO., LTD., Suwon-si (KR)

(72) Inventors: Sangchul Ko, Suwon-si (KR); Sangmoon Lee, Suwon-si (KR); Byeonggeun Cheon, Suwon-si (KR); Dongkyu Park, Suwon-si (KR); Donghyun Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 42 days.

(21) Appl. No.: 16/202,911

(22) Filed: Nov. 28, 2018

(65) Prior Publication Data

US 2019/0166419 A1 May 30, 2019

(30) Foreign Application Priority Data

Nov. 29, 2017 (KR) ..... 10-2017-0161566

(51) Int. Cl.
*H04R 1/32* (2006.01)
*H04R 3/04* (2006.01)
(Continued)

(52) U.S. Cl.
CPC ..... *H04R 1/323* (2013.01); *H04R 1/2803* (2013.01); *H04R 3/04* (2013.01); *H04S 7/30* (2013.01);
(Continued)

(58) Field of Classification Search
CPC . H04R 1/323; H04R 1/34; H04R 1/40; H04R 1/345; H04R 1/347; H04R 1/36;
(Continued)

(56) References Cited

U.S. PATENT DOCUMENTS 9,172,901 B2 10/2015 Chabanne et al.
2008/0205676 A1 8/2008 Merimaa et al.
(Continued)

FOREIGN PATENT DOCUMENTS

EP 3125240 A1 2/2017
KR 10-2005-0115801 A 12/2005
(Continued)

OTHER PUBLICATIONS

International Search Report (PCT/ISA/210) & Written Opinion (PCT/ISA/237) dated Mar. 20, 2019 issued by the International Searching Authority in International Application No. PCT/KR2018/014693.
(Continued)

*Primary Examiner* — Fan S Tsang
*Assistant Examiner* — Angelica M McKinney
(74) *Attorney, Agent, or Firm* — Sughrue Mion, PLLC

(57) ABSTRACT

An apparatus for outputting an audio signal includes: a channel processor configured to generate two or more channel signals from audio data; a signal processor configured to render the generated two or more channel signals; and a directional speaker configured to reproduced a rendered channel signal as an audible sound. The signal processor may include a frequency converter configured to generate a channel signal of a frequency domain by converting the generated two or more channel signals through frequency conversion, and a re-panner configured to change a channel gain of at least one of the generated channel signals by as much as an adjustment value for the channel gain, wherein the adjustment value is monotonically changed as a frequency of the channel signal of the frequency domain increases.

20 Claims, 33 Drawing Sheets

(51) Int. Cl.
*H04R 1/28* (2006.01)
*H04S 7/00* (2006.01)

(52) U.S. Cl.
CPC ..... *H04R 2499/15* (2013.01); *H04S 2400/11* (2013.01)

(58) Field of Classification Search
CPC .. H04R 1/2807; H04R 1/2869; H04R 1/2811; H04R 1/2842; H04R 1/2846; H04R 1/2838; H04R 25/402; H04R 3/04; H04R 3/14
See application file for complete search history.

(56) References Cited

U.S. PATENT DOCUMENTS

| | | | | |
|---|---|---|---|---|
| 2009/0080666 | A1 | 3/2009 | Uhle et al. | |
| 2009/0116652 | A1 | 5/2009 | Kirkeby et al. | |
| 2010/0290630 | A1* | 11/2010 | Berardi | H04S 7/30 381/17 |
| 2012/0101605 | A1* | 4/2012 | Gaalaas | H04S 3/008 700/94 |
| 2012/0183162 | A1 | 7/2012 | Chabanne et al. | |
| 2015/0117686 | A1 | 4/2015 | Kim et al. | |
| 2016/0219364 | A1 | 7/2016 | Seefeldt et al. | |
| 2016/0353205 | A1 | 12/2016 | Munch | |
| 2017/0272881 | A1* | 9/2017 | Geiger | H04S 1/002 |
| 2018/0184227 | A1 | 6/2018 | Chon et al. | |
| 2020/0128346 | A1* | 4/2020 | Noh | H04S 7/303 |

FOREIGN PATENT DOCUMENTS

| | | | |
|---|---|---|---|
| KR | 10-2007-0066820 | A | 6/2007 |
| KR | 10-2008-0060640 | A | 7/2008 |
| KR | 10-2016-0141765 | A | 12/2016 |
| WO | 2012021713 | A1 | 2/2012 |
| WO | 2014/157975 | A1 | 10/2014 |
| WO | 2015/147619 | A1 | 10/2015 |

OTHER PUBLICATIONS

Communication dated Apr. 17, 2019, issued by the European Patent Office in counterpart European Application No. 18208701.5.
Communication dated Mar. 18, 2021 by the Intellectual Property Office of India in counterpart Indian Patent Application No. 201947052118.

* cited by examiner

APPARATUS AND METHOD FOR OUTPUTTING AUDIO SIGNAL, AND DISPLAY APPARATUS USING THE SAME

CROSS-REFERENCE TO RELATED APPLICATION(S)

The application is based on and claims priority under 35 U.S.C. § 119 to Korean Patent Application No. 10-2017-0161566, filed on Nov. 29, 2017 in the Korean Intellectual Property Office, the disclosure of which is incorporated by reference herein in its entirety.

BACKGROUND

1. Field

The disclosure relates to technology for providing a realistic sound to a user through an audio signal output apparatus or display apparatus with one or more directional or omnidirectional speakers.

2. Description of the Related Art

As an acoustic system for playing a three-dimensional (3D) sound, a home-theater system has become widespread. In general, such a system with 5.1 or more channels includes loudspeakers for center (C), front left (FL), font right (FR), surround left (SL), surround right (SR), and the like channels, as well as a subwoofer for a low-frequency effects channel.

However, various factors have made it difficult to provide a home-theater system in home. These factors include space limitations, inconvenience or complexities in cable connection, etc. Further, realistic sound effects are restricted without using a sound system of a home-theater quality level.

Taking these problems into account, a sound bar having a combination of speaker units corresponding to one frequency or different frequencies, and a headphone providing a personalized sound experience have been developed as alternatives to the home-theater system. To change an auditory image, signals have to be processed in their own ways, and then output through corresponding loudspeakers. However, it is difficult to comprehensively consider the number of speaker units, the characteristics of each speaker unit, a listening environment, etc., while processing and distributing the signals.

Such an overall procedure of receiving an audio signal, processing the received audio signal, and distributing processed audio signals to the speaker units is referred to as sound rendering. The foregoing alternatives to the home theater system lack the number of output channels and thus are subjected to a virtualization technique during the sound rendering. Although the virtualization technique is applied, the effects may be limited since body information and listening environments vary from one individual user to another.

For example, in a related art display apparatus that provides a multi-channel audio platform, multi-channel loudspeakers are mounted along a front bezel of a display panel, and the loudspeakers arranged as distributed in such a manner are subjected to gain control to achieve the virtualization. However, the loudspeakers mounted on the front side of the display apparatus restrict a position of an auditory image to an inside of a front display. Therefore, there is a limit to providing proper acoustic effects due to changes in a listening space, a user's posture, etc.

Furthermore, a head-related transfer function (HRTF) and the like customizing technique may be employed. However, this technique also has a physical limit in providing constant acoustic effects, and such a limit is caused by various factors such as system specifications, additional customization, etc.

Accordingly, there is a need for technology that processes an audio signal so that the loudspeakers arranged in the audio signal output apparatus or the display apparatus can, on their own, sufficiently provide a realistic sound and a sound field even in an environment in which a home-theater system is difficult to provide.

SUMMARY

Provided is a display apparatus that uses one or more omnidirectional loudspeakers mounted to one side and one or more directional loudspeakers mounted to a back side of the display apparatus so as to provide a surround sound and the height of acoustic effects to a user, thereby providing a realistic sound to the user.

In accordance with an aspect of the disclosure, a separation phenomenon of an auditory image, which is caused by sound waves emanating from directional loudspeakers being reflected in various indoor environments, is decreased thereby providing a more natural sound to a user.

Additional aspects will be set forth in part in the description which follows and, in part, will be apparent from the description or may be learned by practice of the presented embodiments.

In accordance with an aspect of the disclosure, there is provided an apparatus for outputting an audio signal, the apparatus including: a channel processor configured to generate two or more channel signals from audio data; a signal processor configured to render the generated two or more channel signals; and a directional speaker configured to reproduce a rendered channel signal, among the rendered two or more channel signals, as audible sound, wherein the signal processor includes: a frequency converter configured to generate channel signals of a frequency domain by converting the generated two or more channel signals through frequency conversion; and a re-panner configured to change, by as much as an adjustment value for a channel gain, the channel gain of at least one channel signal of the generated channel signals of the frequency domain, and wherein the adjustment value monotonically varies as a frequency of the at least one channel signal of the generated channel signals of the frequency domain increases.

In accordance with an aspect of the disclosure, there is provided a display apparatus including: an external housing including a front side on which a display panel is provided; an audio signal processing device accommodated in the external housing and configured to process and render, for output, two or more channel signals generated from audio data; and directional speakers of two or more channels, provided on at least one of a back side opposite to the front side of the external housing, a top side of the external housing, or a lateral side of the external housing, and configured to convert the rendered two or more channel signals into audible sound and to output the audible sound in a predetermined directions, wherein the audio signal processing device includes: a frequency converter configured to generate channel signals of a frequency domain by converting the generated two or more channel signals through frequency conversion; and a re-panner configured to change, by as much as an adjustment value for a channel gain, the channel gain of at least one channel signal of the generated channel signals of the frequency domain, and wherein the adjustment value is at least partially varied based on a frequency of the at least one channel signal of the generated channel signals of the frequency domain.

In accordance with an aspect of the disclosure, there is provided a method of outputting an audio signal, which is performed by at least one processor to reproduce and output an audible sound from audio data, the method including: generating two or more channel signals from the audio data; generating channel signals of a frequency domain by converting the generated two or more channel signals through frequency conversion; changing, by as much as an adjustment value for a channel gain, the channel gain of at least one channel signal of the generated channel signals of the frequency domain; and reproducing, as audible sound, the at least one channel signal having the changed channel gain, wherein the adjustment value monotonically varies as a frequency of the at least one channel signal of the generated channel signals of the frequency domain increases.

In accordance with an aspect of the disclosure, there is provided a non-transitory computer-readable recording medium having recorded thereon a program executable by a computer for performing the method.

In accordance with an aspect of the disclosure, there is provided a signal processor for rendering channel signals of audio data for output by directional speakers, the signal processor including: a frequency converter configured to generate channel signals of a frequency domain by converting two or more channel signals, generated from the audio data, through frequency conversion; and a re-panner configured to change, by as much as an adjustment value for a channel gain, the channel gain of at least one channel signal of the generated channel signals of the frequency domain, wherein the adjustment value monotonically varies as a frequency of the at least one channel signal of the generated channel signals of the frequency domain increases.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Below, exemplary embodiments will be described in detail and clearly to such an extent that one of ordinary skill in the art can implement an inventive concept without undue burden or experimentation. Further, it is understood that expressions such as "at least one of," when preceding a list of elements, modify the entire list of elements and do not modify the individual elements of the list. Like numerals refer to like elements throughout.

Below, one or more embodiments will be described with reference to the accompanying drawings.

Figure 1:
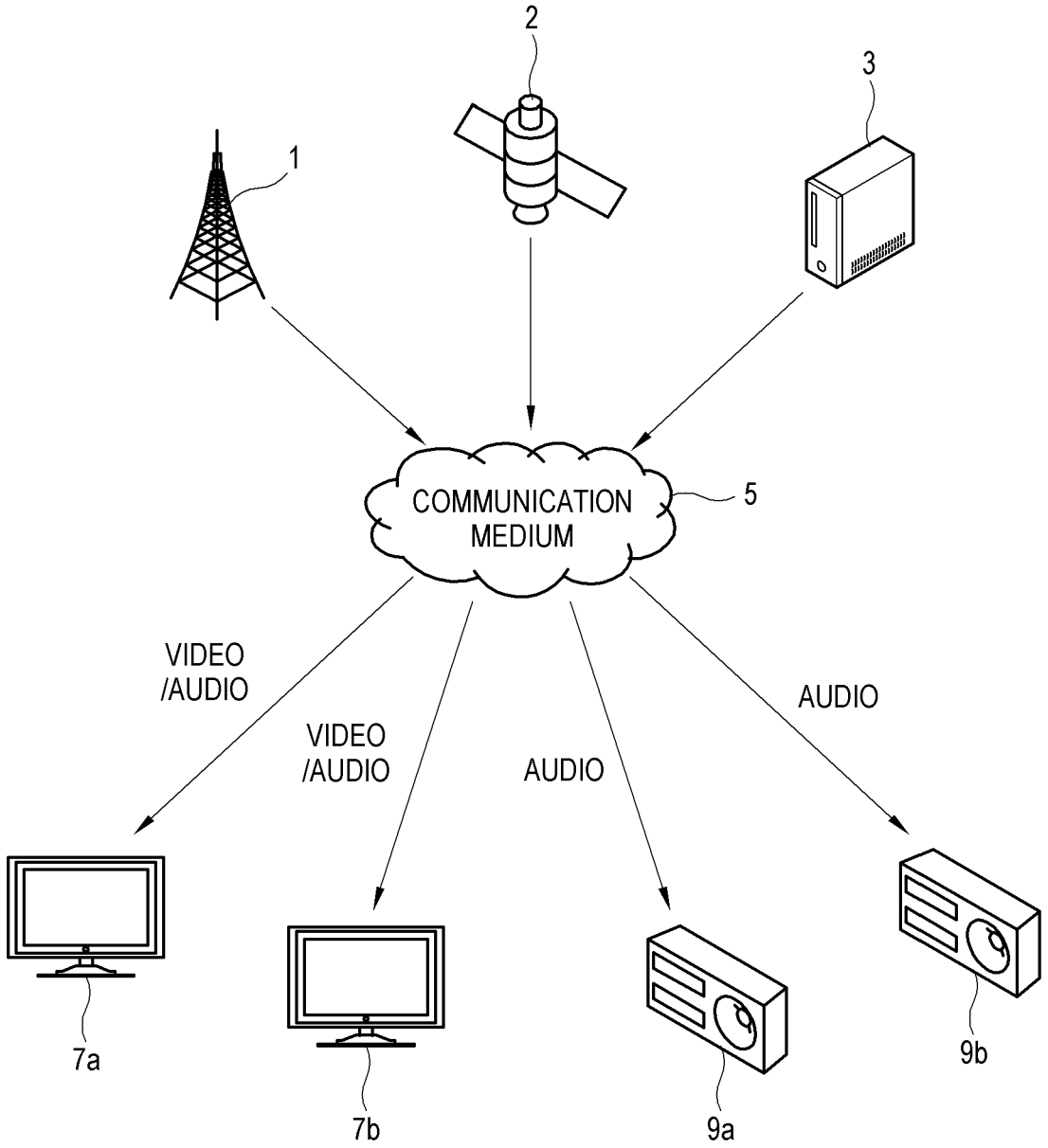
FIG. 1 illustrates an environment in which a sound source is provided to a media player through a network.

FIG. 1 illustrates an environment in which a sound source (i.e., audio source) is provided or connected to media players 7*a*, 7*b*, 9*a* and 9*b* through a communication medium 5. As shown in FIG. 1, a media stream may be transmitted from a broadcast transmitter 1, a satellite 2 and/or a streaming server 3 to the media players 7*a*, 7*b*, 9*a* and 9*b* via the communication medium 5. Here, the broadcast transmitter 1 may be a transmitter or repeater for transmitting a terrestrial broadcast. The satellite 2 may be a communication satellite for transmitting data or media over a long distance. The streaming server 3 may be a server 3 on a communication network for transmitting a broadcast of content, such as an Internet protocol television (IPTV) or a cable TV content. For example, the communication medium 5 may be an over-the-air medium in a case of a terrestrial broadcast or a satellite broadcast, or may be a wired or wireless communication network in a case of the IPTV or the cable TV. The communication network may include a wireless cell network, the Internet, a wide area network (WAN), a local area network (LAN), a wired telephone network, a cable network, etc.

Further, the media players 7*a*, 7*b*, 9*a* and 9*b* comprehensively include display apparatuses 7*a* and 7*b* capable of reproducing both video content and audio content and audio signal output apparatuses 9*a* and 9*b* capable of reproducing audio content but not video content. The display apparatuses 7*a* and 7*b* may include a television, but are not limited thereto. For example, the display apparatuses 7*a* and 7*b* may include a monitor, a smartphone, a desktop computer, a laptop computer, a tablet computer, a navigation system, a digital signage, and the like that includes a display and a loudspeaker and reproduces video and audio content through the display and the loudspeaker, respectively.

Further, the audio signal output apparatuses 9*a* and 9*b* include at least a speaker or an audio output interface (e.g., a 3.5 mm audio terminal, a Bluetooth interface, etc.) for reproducing and outputting the audio content. For example, the audio signal output apparatuses 9*a* and 9*b* may include a radio device, an audio device, a phonograph, a voice recognition loudspeaker, a compact disc (CD) player with a loudspeaker, a digital audio player (DAP), an audio system for a vehicle, home appliances with a loudspeaker, and various other devices for outputting audio.

Accordingly, the display apparatus and the audio signal output apparatus according to an embodiment include at least an audio signal processing device for reproducing and rendering an audio signal from a sound source, and a speaker or audio output interface for outputting the rendered audio signal. Further, the display apparatus includes a display and a video player (e.g., image processor, video decoder, etc.) in addition to the audio signal output apparatus. In this regard, it is understood that the audio signal output apparatus according to an embodiment may be not limited to a standalone audio output device, but may include a component mounted to the display apparatus as a part of the display apparatus.

Further, in FIG. 1 described above, an audio or sound source is provided from the outside of the media player 7*a*, 7*b*, 9*a* and 9*b* via the communication medium 5. However, without limitations, a sound source may be transferred into the media player 7*a*, 7*b*, 9*a* and 9*b* through a portable storage medium such as a universal serial bus (USB) memory, a secure digital (SD) memory card or the like, an optical storage medium, etc. Alternatively, the sound source may be provided as stored in a system memory (e.g., a read only memory (ROM), a basic input/output system (BIOS), etc.) and a storage device, e.g., a hard disk drive (HDD) of the media player 7*a*, 7*b*, 9*a* and 9*b*.

Figure 2:
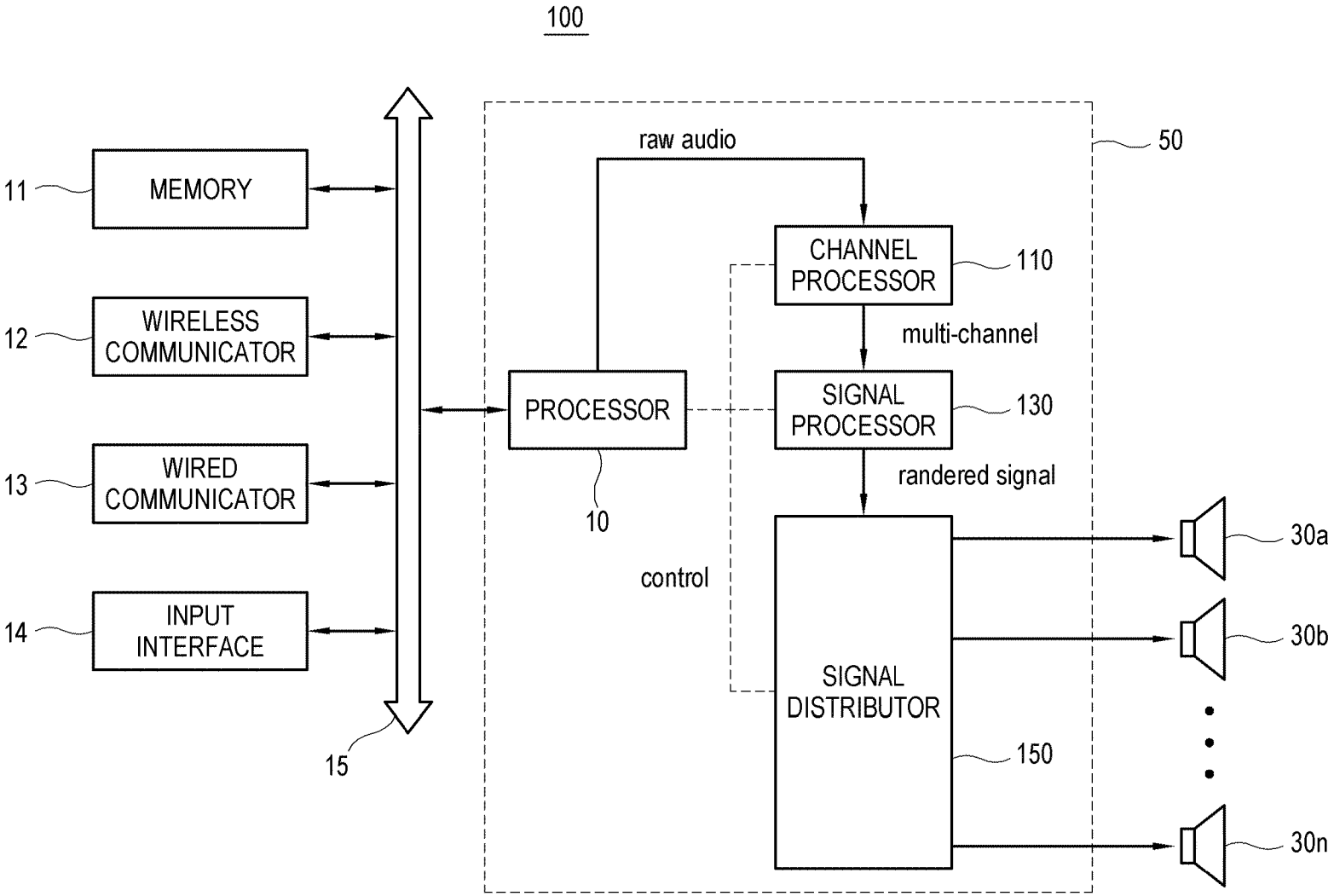
FIG. 2 is a block diagram of an audio signal output apparatus according to an embodiment.

FIG. 2 is a block diagram of an audio signal output device 100 according to an embodiment.

Referring to FIG. 2, the audio signal output apparatus 100 includes an audio signal processing device 50, which includes at least one processor 10 configured to control general operations. The audio signal output apparatus 100 further includes a plurality of sound output devices 30*a*, 30*b* and 30*n*, a memory 11, a wireless communicator 12, a wired communicator 13, and an input interface 14.

Meanwhile, the audio signal processing device 50 may further include a channel processor 110 for generating two or more channel signals from a sound source, a signal processor 130 for rendering the two or more generated channel signals for output, and a signal distributor 150 for outputting the rendered signal.

The processor 10 may be dedicated to control of the channel processor 110, the signal processor 130, and the signal distributor 150, or may be provided to control a general operation of the audio signal output apparatus 100 including the memory 11, the wireless communicator 12, the wired communicator 13, and the input interface 14. According to another embodiment, the processor 10 may be integrated into at least one or a part of the channel processor 110, the signal processor 130, and the signal distributor 150.

Moreover, the channel processor 110, the signal processor 130, and the signal distributor 150 may be integrated into one or more functional modules in various other embodiments. For example, the channel processor 110 and the signal processor 130 may be integrated into one signal processing module, or the signal processor 130 and the signal distributor 150 may be integrated into one signal processing module. Further, the channel processor 110, the signal processor 130 and the signal distributor 150 may be all integrated into one signal processing module.

The processor 10 may, for example, include a central processing unit (CPU), a micro controller unit (MCU), a micro processor (MICOM), an electronic control unit (ECU), an application processor (AP), and/or other electronic units capable of performing various calculations and generating various control signals. The processor 10 may be designed to drive or execute a previously defined application (e.g., program, programming instructions, code, application, or "App"), and perform various control operations in response to a user's input to an input interface 14 and/or according to settings.

Further, the sound source may have various formats such as voice, music and sound effects, which can propagate in the form of waves when reproduced. Here, the sound source includes audio data of at least one channel, and may further include metadata containing information about the audio data. For example, the audio data of at least one channel may include audio data of 2 channels, 3 channels, 5 channels, etc., or may further include audio data of 2.1 channels, 5.1 channels, 7.1 channels, etc., with additional audio data to be reproduced by the subwoofer. In addition, the audio data of at least one channel may further include audio data of 5.1.2 channels, 7.1.4 channels, etc., with an additional height loudspeaker channel for height effects. It is understood that the sound source may include audio data defined in various formats that can be taken into account by a designer.

An analog signal output from the signal distributor 150 is emanated by the plurality of sound output devices 30*a*, 30*b* and 30*n* corresponding to the number of supported channels as an audible sound (i.e., a sound wave) that a user can listen to. The plurality of sound output devices 30*a*, 30*b* and 30*n* may output different sounds or one sound under control of the processor 10. The plurality of sound output devices 30*a*, 30*b* and 30*n* may be provided inside the audio signal output apparatus 100, or may independently communicate with the audio signal output apparatus 100. The plurality of sound output devices 30*a*, 30*b* and 30*n* may include a directional loudspeaker that restores the audible sound from the rendered signal and emanates the audible sound in a specific direction, and/or may include an omnidirectional loudspeaker that outputs a sound of a channel signal different from that of the directional loudspeaker. For example, the directional loudspeaker may output surround signals Ls and Rs, and the omnidirectional loudspeaker may be configured to include loudspeakers for outputting front signals L and R. Further, the omnidirectional loudspeaker may also include a loudspeaker and a subwoofer for respectively outputting a center signal C and a woofer signal LTE which have low directionality like a voice.

According to an embodiment, the processor 10 receives audio data (i.e., a sound source) through a memory 11, a wired/wireless communicator 12/13, and/or the input interface 14, and decodes and converts the audio data into audio data of an uncompressed format. Here, the decoding refers to restoring audio data compressed or encoded by an audio compression format such as MPEG layer-3 (MP3), advanced audio coding (AAC), an audio codec-3 (AC-3), digital theater system (DTS), free lossless audio codec (FLAC), Windows media audio (WMA), etc., into audio data of an uncompressed or decoded format. Of course, when the sound source has not been compressed or encoded, such a decoding process may be omitted. The restored audio data may include one or more channels. For example, when the sound source is audio data of 5.1 channels, the one or more channels of the restored audio data include six channels L, R, C, LFE, Ls and Rs with an additional subwoofer signal. In this case, the processor 10 provides the restored audio data to the channel processor 110, and generates and transmits a control signal for controlling the operations of the channel processor 110, the signal processor 130, and the signal distributor 150.

The channel processor 110 determines whether the provided audio data corresponds to or matches with the number of sound output devices or loudspeaker devices 30*a*, 30*b* and 30*n*, and may perform channel mapping as needed. For example, when the sound source includes audio data of which channels are less than the number of input channels of the channel processor 110, the channel processor 110 performs up-mixing to increase the number of channels of the audio data (i.e., source audio data) and provides the audio data with the increased number of channels to the signal processor 130. On the other hand, when the sound source includes audio data of which channels are greater than the number of loudspeaker devices 30*a*, 30*b* and 30*n*, the channel processor 110 performs down-mixing to decrease the number of channels of the audio data to match with the number of loudspeaker devices 30*a*, 30*b* and 30*n*. Of course, when the number of channels of the sound source is equal to the number of loudspeaker devices 30*a*, 30*b* and 30*n*, the signal processor 110 may not perform any separate up-mixing or down-mixing process.

The signal processor 130 performs a signal process to render the plurality of channel signals, which are received from the channel processor 110, for output, and provides the rendered signal to the signal distributor 150. In particular, the signal processor 130 subjects the plurality of generated channel signals to frequency conversion to thereby generate channel signals of a frequency domain. Then, adjusts a channel gain of the channel signals of the frequency domain that belong to an adjustment frequency range, among the generated channel signals of the frequency domain. Here, the signal processor 130 changes a channel gain as much as an adjustment value. Since the signal processor 130 performs the signal process by considering reflective properties in an indoor space and/or the directionality of the directional loudspeakers 30-1 and 30-2 included in the loudspeaker devices 30*a*, 30*b* and 30*n*, a user may hear more realistic sound from the audio signal output apparatus 100. More detailed operations performed in the signal processor 130 will be described below with reference to FIG. 15.

The channel processor 110 and the signal processor 130 may be physically and/or logically separable from each other. In the case of being physically separated, the channel processor 110 and the signal processor 130 may be materialized or embodied by individual circuits or semiconductor chips, respectively.

The signal distributor 150 may perform the channel mapping on the audio signal rendered in the signal processor 130. Specifically, the signal distributor 150 may distribute the channels of the audio data to the plurality of loudspeaker devices 30*a*, 30*b* and 30*n* and thereby determine the audio data to be output. In this case, the signal distributor 150 may distribute the channels to the plurality of loudspeaker devices 30*a*, 30*b* and 30*n* on the basis of additionally given metadata. By this process, the audio data that each of the plurality of loudspeaker devices 30*a*, 30*b* and 30*n* outputs is determined.

Meanwhile, the signal distributor 150 may further include a digital-to-analog converter (DAC) for converting a digital signal output by the channel mapping into an analog signal, and/or a signal amplifier for amplifying the analog signal. Thus, the signal converted into the analog signal and then subjected to the amplification is transmitted to typical passive loudspeakers and changed into an audible sound. On the other hand, when the loudspeaker devices 30*a*, 30*b* and 30*n* are materialized or embodied by an active loudspeaker with a signal amplifier, when the loudspeakers with the DAC are present, or when a separate audio receiver or amplifier is present, the signal distributor may be provided without the DAC or the amplifier.

Referring back to FIG. 2, the audio signal output apparatus 100 may include at least one among the memory 11, the wireless communicator 12, the wired communicator 13, and the input interface 14, and may be electrically connected to the processor 10 via a system bus 15. The memory 11, the wireless communicator 12, the wired communicator 13 and/or the input interface 14 may operate independently or together to thereby provide the audio data (i.e., source audio data or sound source) to the processor 10.

The memory 11 is configured to temporarily or non-temporarily store the audio data, and transmits the audio data to the processor 10 in response to a call or instruction from the processor 10. Further, the memory 11 may be configured to store various pieces of information for the calculation, process or control operations of the processor 10 in an electronic format. For example, the memory 11 may be configured to store all or a part of various pieces of data, applications, filters, algorithms, instructions, code, etc., for the operations of the processor 10, and provide the same to the processor 10 as needed or instructed. Here, the application may be obtained through an electronic software distribution network accessible by the wireless communicator 12 or the wired communicator 13.

The memory 11 may for example include at least one of a main memory unit and an auxiliary memory unit. The main memory unit may be materialized or embodied by a semiconductor storage medium such as a read-only memory (ROM) and/or a random-access memory (RAM). The ROM may for example include a typical ROM, an erasable and programmable read only memory (EPROM), an electrically erasable and programmable read only memory (EEPROM), a mask ROM, and/or etc. The RAM may for example include a dynamic RAM (DRAM), a static RAM, and/or the like. The auxiliary memory unit may be materialized or embodied by at least one of a flash memory unit, a secure digital (SD) card, a solid state drive (SSD), a hard disk drive (HDD), a magnetic drum, an optical recording media such as a compact disc (CD), a digital versatile disc (DVD), a laser disc (LD), etc., a magnetic tape, a magnetooptical disc, a floppy disk, and/or the like storage medium capable of permanently or semi-permanently storing data.

The wireless communicator 12 is provided to communicate with at least one of external server devices 1, 2 and 3 on the basis of a wireless communication network, receives audio data from another terminal device or server device, and transmits the received audio data to the processor 10. The wireless communicator 12 may be materialized or embodied with an antenna, a communication chip, a substrate, and the like for transmitting an electromagnetic wave externally or receiving an electromagnetic wave from an external source.

Further, the wireless communicator 12 may be provided to communicate with at least one of the external server devices 1, 2 and 3 through wireless communication technology, or at least one of the server devices 1, 2 and 3 through long distance communication technology, e.g., mobile communication technology.

The wireless communication technology may for example include Bluetooth, Bluetooth Low Energy, a controller area network (CAN), Wi-Fi, Wi-Fi Direct, ultra-wide band (UWB), ZigBee, infrared data association (IrDA), near field communication (NFC), etc. The mobile communication technology may for example include 3GPP, Wi-Max, long term evolution (LTE), etc.

The wired communicator 13 is provided to communicate with at least one of the external server devices 1, 2 and 3 through a wired communication network, to receive audio data from another terminal device or server device, and to transmit or provide the received audio data to the processor 10. Here, the wired communication network may for example be materialized or embodied by a pair cable, a coaxial cable, an optical fiber cable, an Ethernet cable or the like physical cable.

However, either of the wireless communicator 12 or the wired communicator 13 may be omitted in one or more embodiments. Therefore, the audio signal output apparatus 100 may include the wireless communicator 12 without the wired communication 13 or may include the wired communicator 13 without the wireless communicator. Further, the audio signal output apparatus 100 may include an integrated communicator that supports both the wireless connection using the wireless communicator 12 and the wired connection using the wired communicator 13.

The input interface 14 is connectable to a device provided separately from the audio signal output apparatus 100, for example, an external storage device, receives audio data from another device, and transmits the received audio data to the processor 10. For example, the input interface 14 may be a USB terminal, and may also include at least one of various interface terminals such as a high definition multimedia interface (HDMI) terminal, a thunderbolt terminal, etc.

Figure 3:
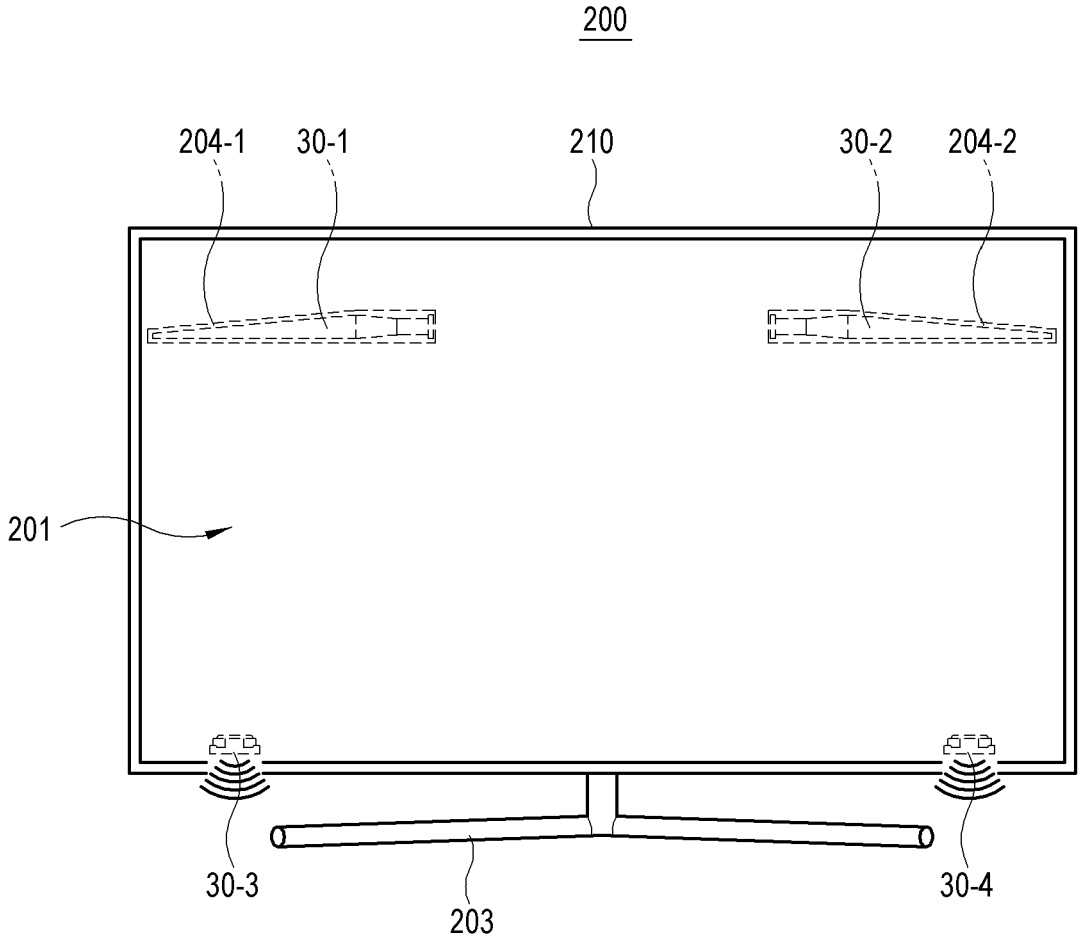
FIG. 3 is a front view of a display apparatus according to an embodiment.
Figure 4:
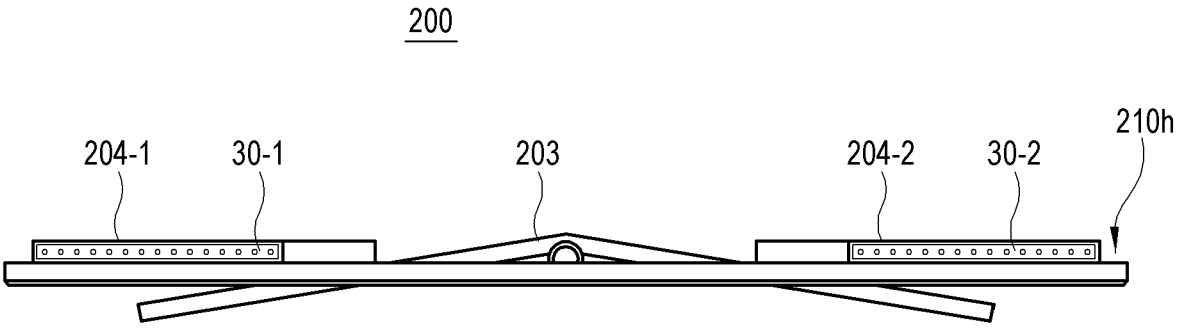
FIG. 4 is a plan view of the display apparatus of FIG. 3.

FIG. 3 is a front view of a display apparatus 200 according to an embodiment, and FIG. 4 is a plan view of the display apparatus 200 according to an embodiment. The display apparatus 200 may be configured to include an audio signal processing device 50 and a loudspeaker device 30 as described above. The audio signal processing device 50 may be internally provided in the display apparatus 200 or may be separately provided from the display apparatus 200 and connectable to the display apparatus 200.

As shown in FIG. 3, the display apparatus 200 may include a display panel 201, and a housing 210 holding the display panel 201 and accommodating various built-in parts related to the operations of the display apparatus 200. The display panel 201 displays an image for viewing by a user. The display panel 201 may for example include a liquid crystal display (LCD) using liquid crystal, a display panel using a light emitting diode (LED) autonomously emitting light, a display panel using an organic light emitting diode (OLED) or an active matrix organic light emitting diode (AMOLED), a quantum dot (QD) display panel, etc.

Further, the display apparatus 200 may further include a back-light unit (BLU) for illuminating the display panel 201 as needed or instructed, and the BLU may be provided inside the housing 210. The display panel 201 may include a rigid display panel or a flexible display panel according to various embodiments.

The housing 210 is provided with the display panel 201 exposed at a front side, and directional speakers 30-1 and 30-2 installed at a back side **210*h*. However, it is understood that the directional speakers 30-1 and 30-2 are not necessarily installed on the rear side of the display panel 201 in one or more other embodiments. Alternatively, the directional loudspeakers may be installed or provided at any position, including at a top side, a lateral side, a bottom side, etc., of the display panel 201**, so long as there are some paths in which emanated sound waves are reflected without being directly transferred to a user.

According to one or more embodiments, the housing 210 may be additionally provided with a stand 203 for supporting the display apparatus 200. The stand 203 may be installed or provided at a suitable position to support the display apparatus 200, such as the bottom side, the back side **210*h*, etc., of the display apparatus 100. When the display apparatus 200 is mounted to a wall, the stand 203** may be omitted.

The directional speakers 30-1 and 30-2 may be installed at certain positions on the back side **210*h* of the housing 210, and additional speakers 30-3 and 30-4 may be additionally provided at different positions. To install the directional speakers 30-1 and 30-2, accommodating brackets 204-1 and 40-2 may be further provided on the back side 210*h* of the housing. Furthermore, the additional speakers 30-3 and 30-4** may include directional and/or omnidirectional speakers according to various embodiments. In the following description, the omnidirectional speaker will be described by way of example.

The omnidirectional speakers 30-3 and 30-4 may be materialized using typical speaker devices, which are installed within the housing 210 and emanate an audible sound via a through hole formed in the housing 210 in a frontward or downward direction. FIG. 3 illustrates that the display apparatus 200 includes two omnidirectional speakers. Alternatively, the display apparatus 200 may include only one omnidirectional speaker, or three or more omnidirectional speakers with a center speaker and/or a subwoofer, without limitations.

The directional speakers 30-1 and 30-2 may be installed on the back side **210*h* of the housing 210, but not limited thereto. Alternatively, the directional speakers may be installed in an upper portion of the back side 210*h* in order to decrease the thickness of the display apparatus 200. Further, the directional speakers 30-1 and 30-2 may be installed as close to the upper portion of the housing back side 210*h* as shown in FIG. 3, but may be installed as close to a middle or lower portion of the housing back side 210*h***.

Further, the directional speakers 30-1 and 30-2 may be installed so that each sound maker 31 (see FIG. 5) can be oriented toward the center, and a cap 34 (see FIG. 5) can be oriented toward a left or right border. In this case, the directional speakers 30-1 and 30-2 are installed in the housing back side **210*h* in substantially parallel with an upper border of the housing 210. Of course, the directional speakers 30-1 and 30-2 may be installed on the back side 210***h* as inclined at a predetermined angle to the upper border of the housing 210.

Figure 5:
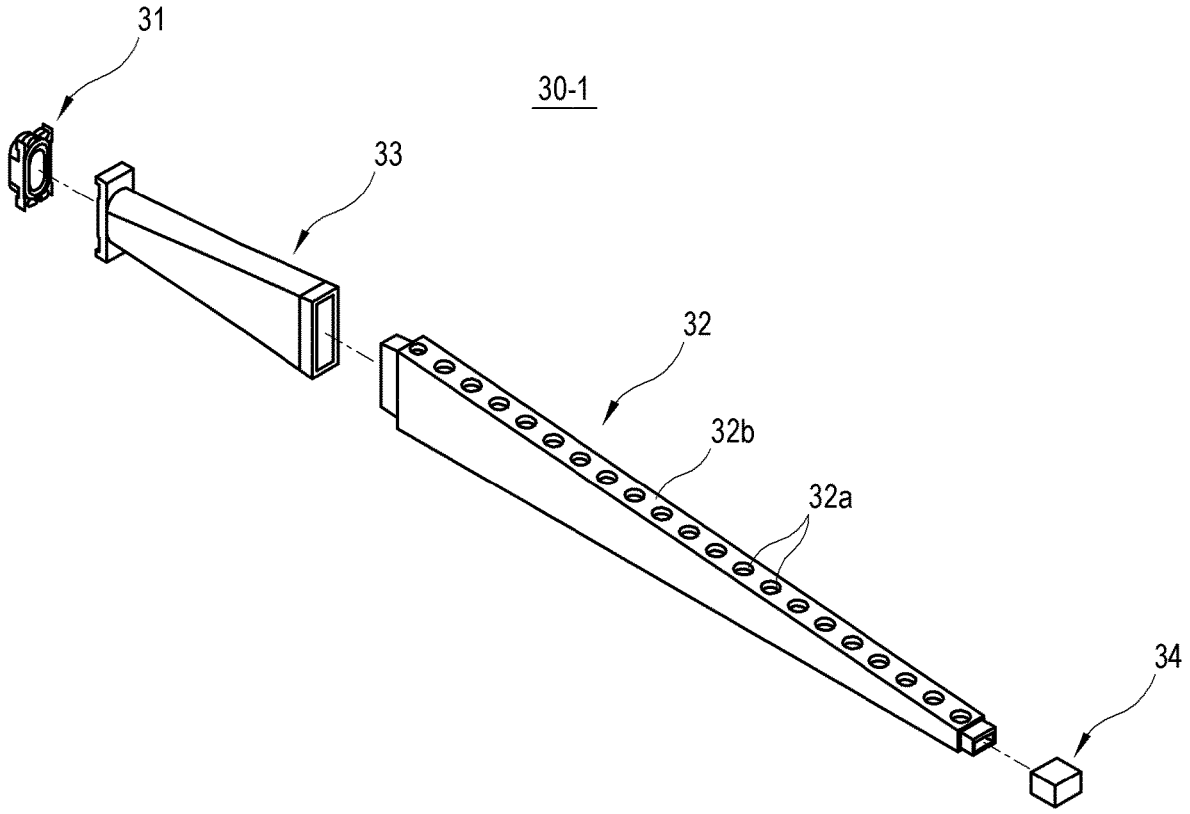
FIG. 5 is an exploded perspective view illustrating a directional loudspeaker in more detail according to an embodiment.
Figure 6:
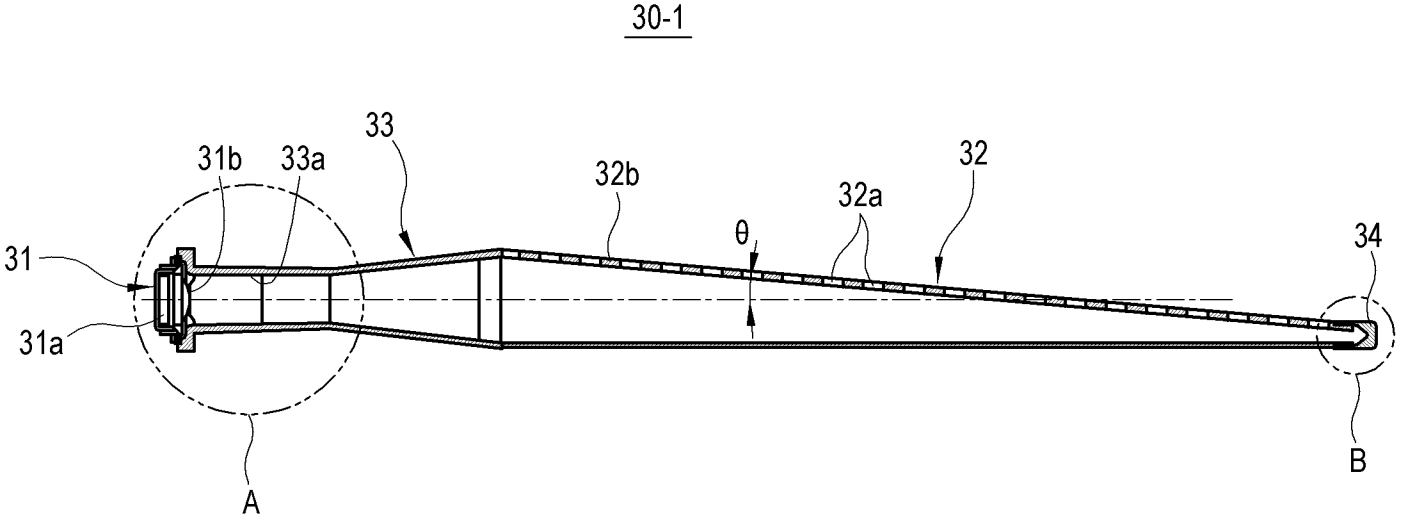
FIG. 6 is a longitudinal cross-sectional view illustrating a directional loudspeaker in more detail according to an embodiment.

FIG. 5 is an exploded perspective view illustrating the directional speaker 30-1 in more detail according to an embodiment. FIG. 6 is a longitudinal cross-sectional view illustrating the directional speaker 30-1 in more detail according to an embodiment. It is understood that, in various embodiments, the directional speaker 30-2 has the same or similar structure as the directional speaker 30-1, but differs in position, placement, and/or orientation. As such, the directional speaker 30-1 will be representatively described below.

As shown in FIGS. 5 and 6, the directional speaker 30-1 has a structure of an end-fire radiator. Specifically, the directional speaker 30-1 includes a sound maker 31 (e.g., driver) for making or generating a sound, a guide pipe 32 having a hollow pipe shape and guiding the sound to emanate from the sound maker 31 to the outside, a throat pipe 33 (or neck pipe) arranged between the sound maker 31 and the guide pipe 32 and having a first end in which the sound maker 31 is installed and a second end to which a first end of the guide pipe 32 is connected, and a cap 34 for covering a second end of the opened guide pipe 32.

As shown in FIG. 6, the sound maker 31 includes an electromagnet 31*a* receiving an electric signal and generating a magnetic force, and a diaphragm 31*b* that is vibrated by the electromagnet 31*a* and makes a sound. The throat pipe 33 is formed as a hollow pipe, and gradually increases in internal width. Therefore, the throat pipe 33 guides the sound made in the sound maker 31 (e.g., driver) toward the guide pipe 32, and reduces noise that may occur due to sudden pressure change.

As shown in FIG. 5, the guide pipe 32 may include a plurality of emanation holes 32*a* arranged in a line along a lengthwise direction of the guide pipe 32 on at least one side, and allowing a sound to emanate outward. The plurality of emanation holes 32*a* may be formed on at least one side of the guide pipe 32 and spaced apart from each other at regular intervals or at irregular intervals according to various embodiments.

According to an embodiment, the emanation holes 32*a* may be formed or provided to increase in size from the first end of the guide pipe 32 positioned at the sound maker 31 (e.g., driver) to the second end opposite to the first end. This causes more sound be emanated through the emanation holes 32*a* positioned close to the second side of the guide pipe 32, thereby increasing the directionality of the sound made in a direction corresponding to the lengthwise direction of the guide pipe 32.

FIG. 5 shows that the plurality of emanation holes 32*a* are arranged in a row on one lateral side of the guide pipe 32. Alternatively, the plurality of emanation holes 32*a* may be arranged in a plurality of rows on one lateral side of the guide pipe 32. Further, the plurality of emanation holes 32*a* may be arranged in a row or in a plurality of rows on a plurality of lateral sides of the guide pipe 32. The hollow guide pipe 32 may be formed to have an approximately quadrangular internal cross-section. However, this is for illustrative purposes only, and the guide pipe may be alternatively formed to have a circular, triangular or the like internal cross-section.

The hollow guide pipe 32 has an emanation surface 32*b* on which the emanation holes 32*a* are formed and through which a sound is emanated. As described above, when the emanation holes 32*a* are provided in a row on the emanation surface 32*b* of the guide pipe 32, a sound propagated through the throat pipe 33 is partially emanated outward through each of the emanation holes 32*a* while passing through the guide pipe 32.

Because a sound is a wave using air as a medium for propagating based on pressure change, destructive and constructive interferences may occur between sounds emanated through the emanation holes 32*a* provided in a row in the guide pipe 32 while leaving time lags. While the sounds interfere with each other, the sounds have the directionality in a direction corresponding to the lengthwise direction of the guide pipe 32. Therefore, the directional speakers 30-1 and 30-2 can operate as the directional speakers 30-1 and 30-2 due to the structure of the guide pipe 32 formed with the emanation holes 32*a*.

The sound propagating in the guide pipe 32 emanates through the emanation holes 32*a* while passing through the guide pipe 32. Therefore, when the guide pipe 32 gradually tapers with the decreasing internal cross-sections from the first end toward the second end, a sound emanates from the emanation hole 32*a* adjacent to the second end of the guide pipe 32 at the same level as those from different emanation holes 32*a* even though sound pressure gradually decreases while passing through the guide pipe 32.

Further, when the internal cross-section of the guide pipe 32 gradually decreases from the first end toward the second end of the guide pipe 32, most of the sounds propagating in the guide pipe 32 emanate through the emanation holes 32*a* so that the sound made in the sound maker 31 can more efficiently emanate outward. As such sounds emanating outward through the emanation hole 32*a* increase, sounds reaching the cap 34 positioned at the second end of the guide pipe 32 decrease. In other words, noise caused when the sound reaching the cap 34 returns toward the sound maker 31 is reduced by decreasing the internal cross-section of the guide pipe 32.

As illustrated, the emanation surface 32*b* may be at an acute angle relative to the lengthwise direction of the guide pipe 32. Since the emanation hole 32*a* is provided on the emanation surface 32*b* as described above, the sound is guided to emanate by the emanation surface 32*b*. The emanation surface 32*b* of the directional speakers 30, 30-1 and 30-2 may be formed at a predetermined angle θ to the lengthwise direction of the guide pipe 32. Since the sound is guided by the emanation surface 32*b* and emanates, the directionality of the directional speakers 30, 30-1 and 30-2 is varied depending on the angle θ between the lengthwise direction of the guide pipe 32 and the emanation surface 32*b*. Specifically, the directionality of the directional speakers 30, 30-1 and 30-2 increases with the increasing angle θ between the lengthwise direction of the guide pipe 32 and the emanation surface 32*b*.

The cap 34 is placed at the second end of the opened guide pipe 32 and closes the second end of the guide pipe 32. Further, the cap 34 facing the second end of the guide pipe 32 is internally formed with gradually decreasing upper and lower widths. The upper and lower widths intersect to have an approximately V-shaped groove. Thus, destructive interference occurs as the sound reaching the cap 34 is reflected from the inside of the cap 34, thereby reducing noise caused when the sound reaching the second end of the guide pipe 32 is reflected back toward the sound maker 31.

Figure 7:
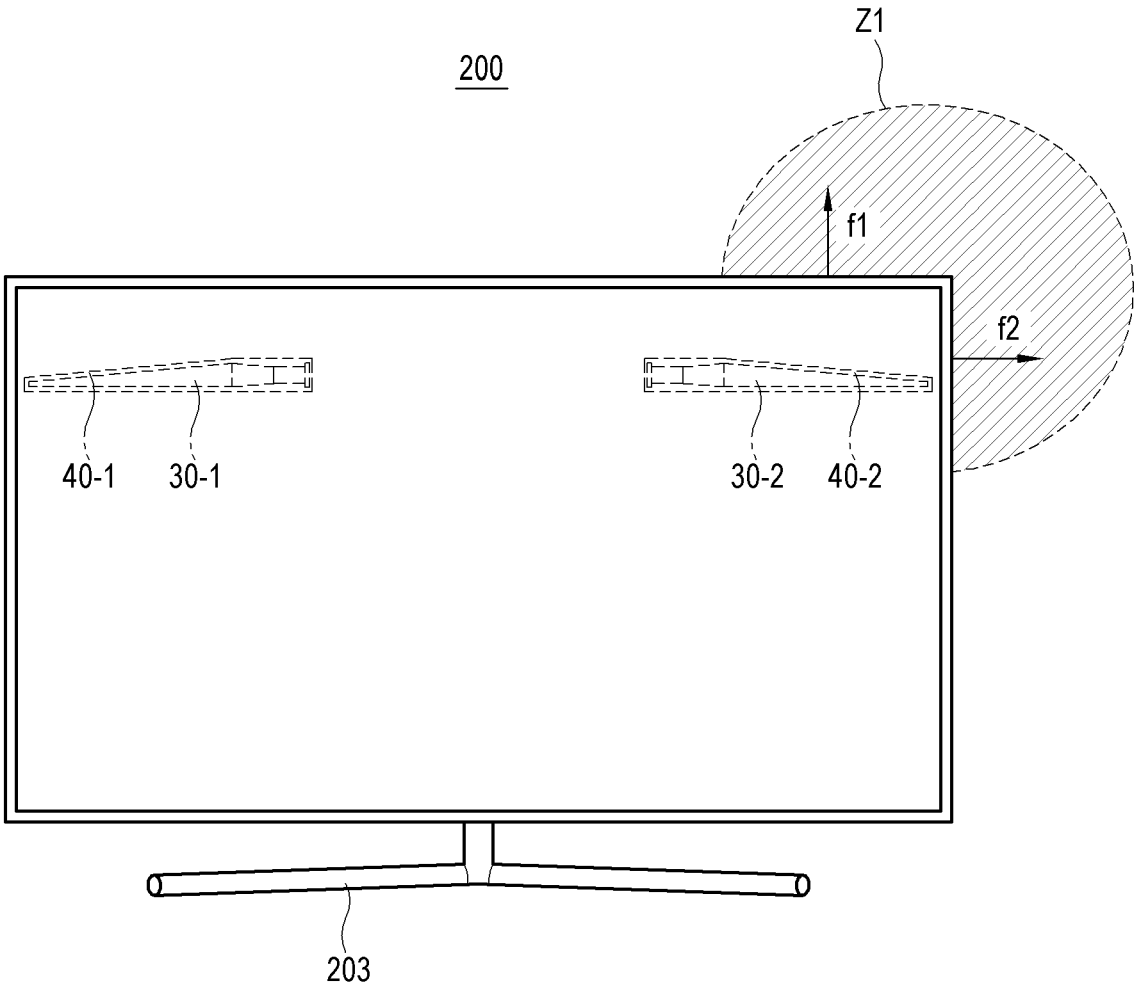
FIG. 7 is a view illustrating emanating characteristics of a directional loudspeaker provided on a back side of a display apparatus.

FIG. 7 is a view illustrating emanating characteristics of the directional speakers 30-1 and 30-2 installed on the back side of the display apparatus 200 according to an embodiment. As described above, the directional speakers 30-1 and 30-2 are installed on accommodating brackets 40-1 and 40-2 formed around the upper border of the back side 210*h* so that the emanation holes 32*a* can be exposed upward. In this case, as shown in FIG. 7, sounds emanating from the directional speakers 30-1 and 30-2 propagate within a zone Z1 around each upper corner of the display apparatus 100 in upward, sideward and backward directions. In this case, a sound having a relatively low frequency f1 emanates in the upward direction, and a sound having a relatively high frequency f2 emanates in the sideward direction.

In this manner, the emanating characteristics, which the directional speakers 30-1 and 30-2 installed on the back of the display apparatus 200 have, show some physical properties. First, sounds emanating from the directional speakers 30-1 and 30-2 are not directly transmitted to a user due to the display panel 201. Further, the sound emanating from the directional speakers 30-1 and 30-2 change in directionality as reflected from the display panel 201. Further, when general room environments of a user are taken into account, the sounds emanating from the directional speakers 30-1 and 30-2 are reflected from the ceiling and the left and right walls and thus transmitted to a user via multiple paths. With these physical properties, the paths and characteristics of transmitting the sounds emanating from the directional speakers 30-1 and 30-2 to a user will be described in detail.

Figure 8:
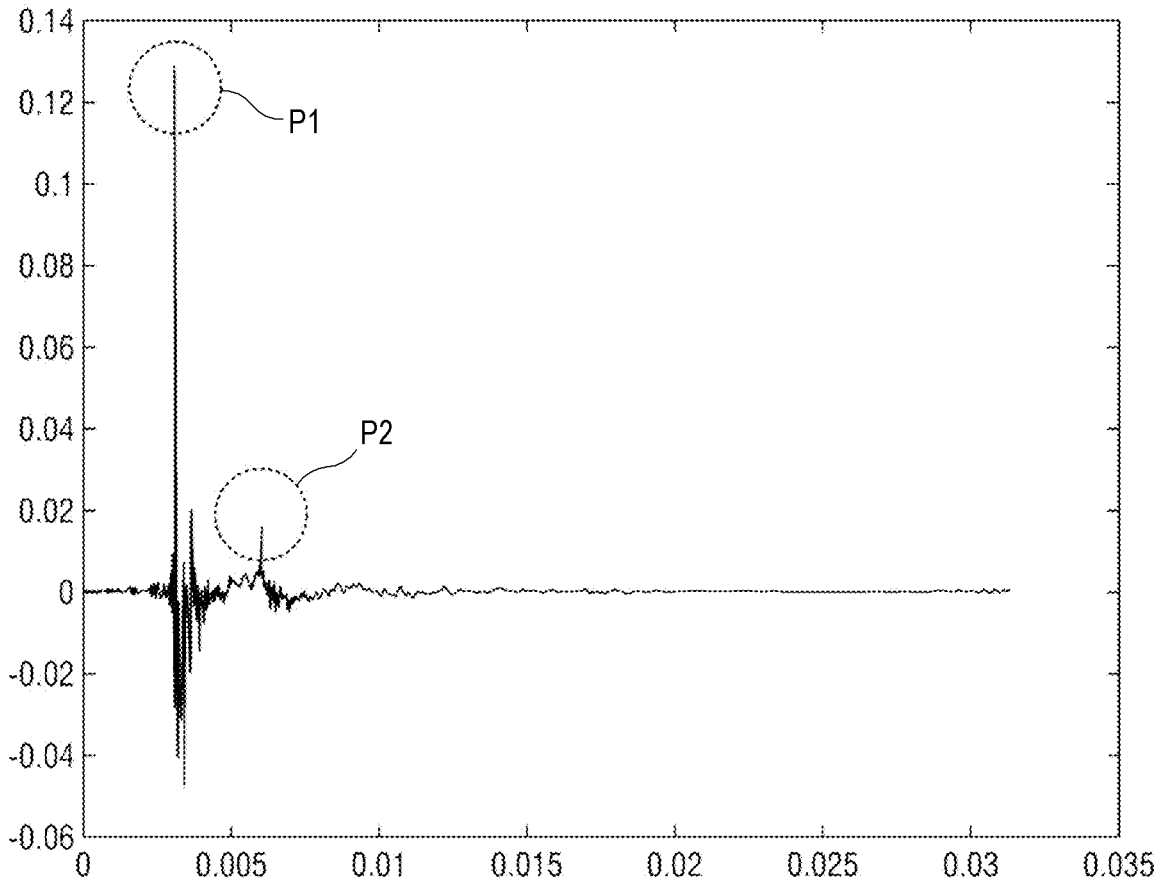
FIG. 8 is a graph showing an impulse response measured between an audio signal transmitted to an omnidirectional loudspeaker and a signal measured by a microphone arranged at a certain distance from the omnidirectional loudspeaker.

First, the acoustic characteristics of the omnidirectional speakers 30-3 and 30-4 are shown in FIG. 8. Here, the axis of abscissae indicates time, and the axis of ordinates indicates an amplitude of a sound wave. Specifically, FIG. 8 is a graph of impulse responses between an audio signal transmitted to the omnidirectional speakers 30-3 and 30-4 and a signal measured in a microphone arranged at a distance of 1 m from the omnidirectional speakers 30-3 and 30-4.

As illustrated in FIG. 8, a peak P1 caused by a direct sound wave appears at a time of 3 ms corresponding to the distance between the omnidirectional speakers 30-3 and 30-4. Then, the second peak P2 caused by a sound wave reflected from a floor appears around a time of 6.5 ms. This means that the signal transmitted to the directional speakers 30-3 and 30-4 reaches the microphone independently of the frequency.

Figure 9:
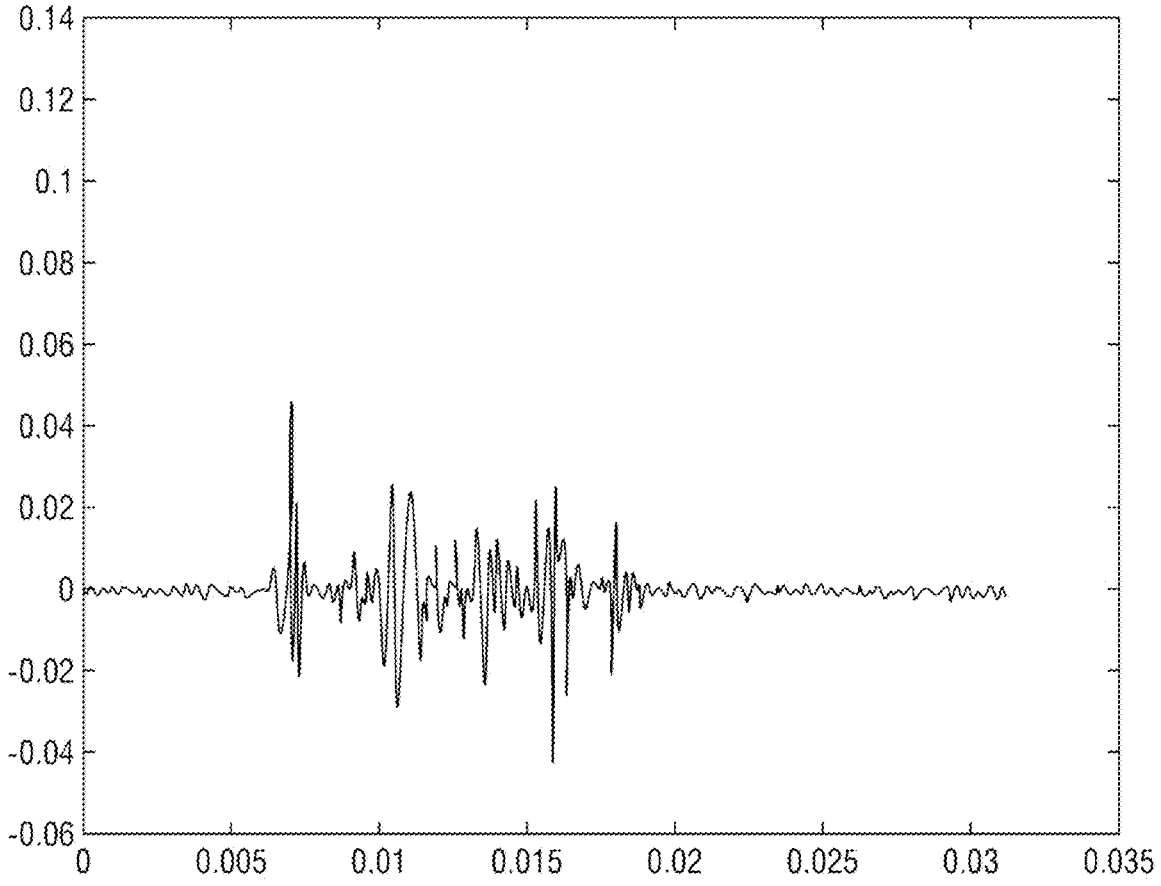
FIG. 9 is a graph showing acoustic characteristics propagated by a directional loudspeaker.

On the other hand, the acoustic characteristics of the directional speakers 30-1 and 30-2 are shown in FIG. 9. In this case, the measuring environments and the axes of abscissae and ordinates are the same as those of FIG. 8. The directional speakers 30-1 and 30-2 are placed on the back of the display apparatus 200, and the impulse responses are also measured and shown in FIG. 9. First, a direct path between the microphone and the directional speakers 30-1 and 30-2 is obstructed by the display panel, and thus no peaks are present around the time of 3 ms corresponding to the distance between the speaker and the microphone. Then, the sound waves are transmitted to the microphone via various paths as opposed to those of the omnidirectional speakers 30-3 and 30-4.

Figure 10:
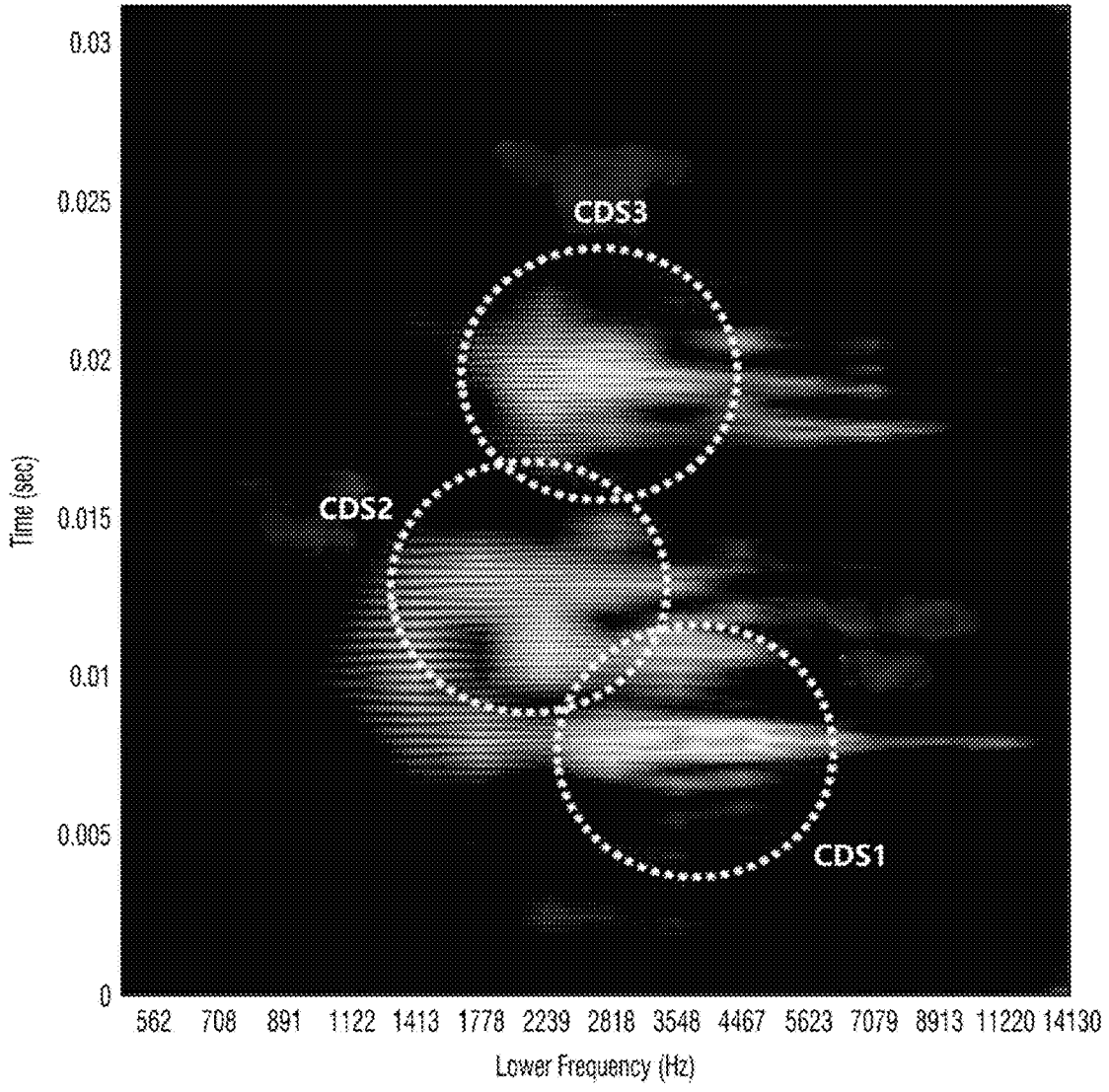
FIG. 10 is a view divisionally illustrating the characteristics shown in FIGS. 8 and 9 according to frequency bands.

The characteristics shown in FIGS. 8 and 9 are sorted as shown in FIG. 10 according to the frequency bands. In FIG. 10, the axis of abscissa indicates a ⅓ octave band, and the axis of ordinates indicates time. As shown in FIG. 10, the peaks appear at different points on the axis of time according to the frequency bands. A sound wave CDS2 having frequencies lower than or equal to about 2.2 kHz is transmitted to the microphone leaving a delay time of about 10~13 ms, whereas a sound wave having frequencies higher than or equal to 2.2 kHz is transmitted via two paths.

One sound wave CDS3 between the sound waves corresponding to the two paths is a sound wave transmitted leaving a delay time of about 17~22 ms, and the other sound wave CDS1 is a sound wave transmitted via a different path leaving a delay time of about 7~8 ms. Ultimately, the sound wave CDS2 having the frequency lower than or equal to about 2.2 kHz is transmitted to the microphone as reflected from the ceiling, and the sound wave having the frequency higher than or equal to about 2.3 kHz is transmitted to the microphone as a signal CDS1 reflected from the rear wall or a signal CDS3 reflected from the left and right walls. As such, when the directional speakers 30-1 and 30-2 according to an embodiment are arranged on the back side 210*h* of the display apparatus 200, the characteristics of transmitting the sound waves to a user are varied depending on the frequencies.

Figure 11:
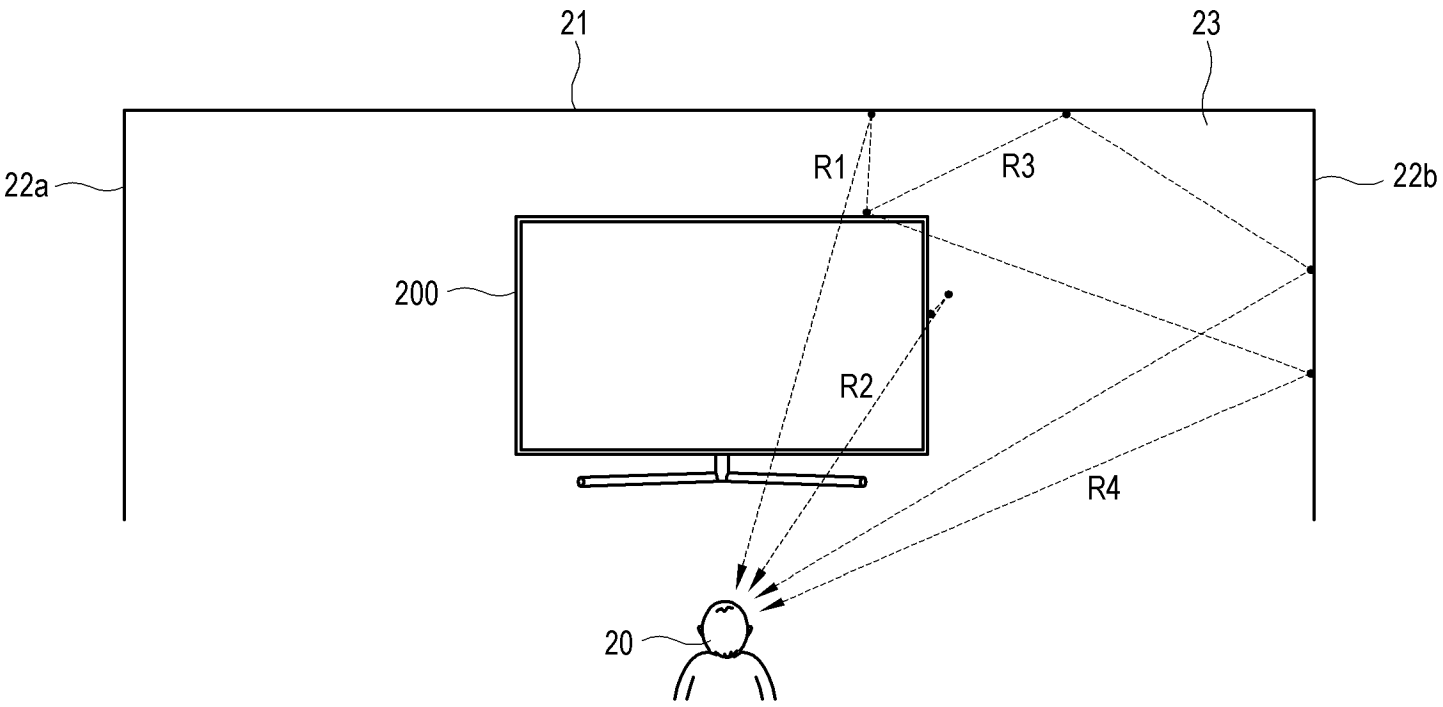
FIG. 11 is a view schematically illustrating propagating paths different according to frequencies as shown in FIG. 10.

FIG. 11 schematically shows such transmission paths varied depending on frequencies as shown in FIG. 10. Referring to FIG. 11, a sound wave emanating from the right directional speaker 30-2 may be transmitted to a user 20 via approximately four reflection paths R1~R4. First, a sound wave having a low frequency of 1.1~2.2 kHz is transmitted to the user 20 via a path R1 as reflected from a ceiling 21. Of course, a sound wave having a frequency lower than the low frequency may be transmitted to the user 20 without reflection as such a sound wave is diffracted without directionality.

Further, a sound wave of 4~9 kHz is transmitted to the user 20 via a path R2 as reflected from—not the ceiling 21—but a rear wall 23. In addition, a sound wave of 2.2~10 KHz is transmitted to the user 20 via a path R3 as reflected from both the ceiling 21 and the lateral walls 22*b* or via a path R4 as reflected from the right wall 22*b*. The paths shown in FIG. 11 are illustrated with respect to the right directional speaker 30-2. When the right wall 22*b* is bilaterally symmetrical to a left wall 22*a*, the reflection path of the sound wave transmitted from the left directional speaker 30-1 is also bilaterally symmetrical to the path illustrated in FIG. 11.

In this manner, the sound waves emanating from the directional speakers 30-1 and 30-2 are reflected and transmitted over different paths according to their frequencies because of the directionalities of the directional speakers 30-1 and 30-2, the placement of the directional speakers 30-1 and 30-2 on the back of the display apparatus 200, and a room structure such as a ceiling, rear wall, lateral walls, etc. Such environments go against supposition of a point-source, and therefore a realistic sound rendering method according to an embodiment is implemented in consideration of the sound characteristics based on the placement of the directional speakers 30-1 and 30-2 in the display apparatus 200 and the room environments.

Specifically, transmission characteristics (e.g., delay time) that vary according to the frequency bands shown in FIG. 10 are observed even when the directional speakers 30-1 and 30-2 are fixedly arranged in a stationary manner on the back of the display apparatus 200. In other words, the emanating directions of the directional speakers 30-1 and 30-2 are varied depending on the frequencies, and thus reflection positions also vary according to the frequencies.

Figure 12:
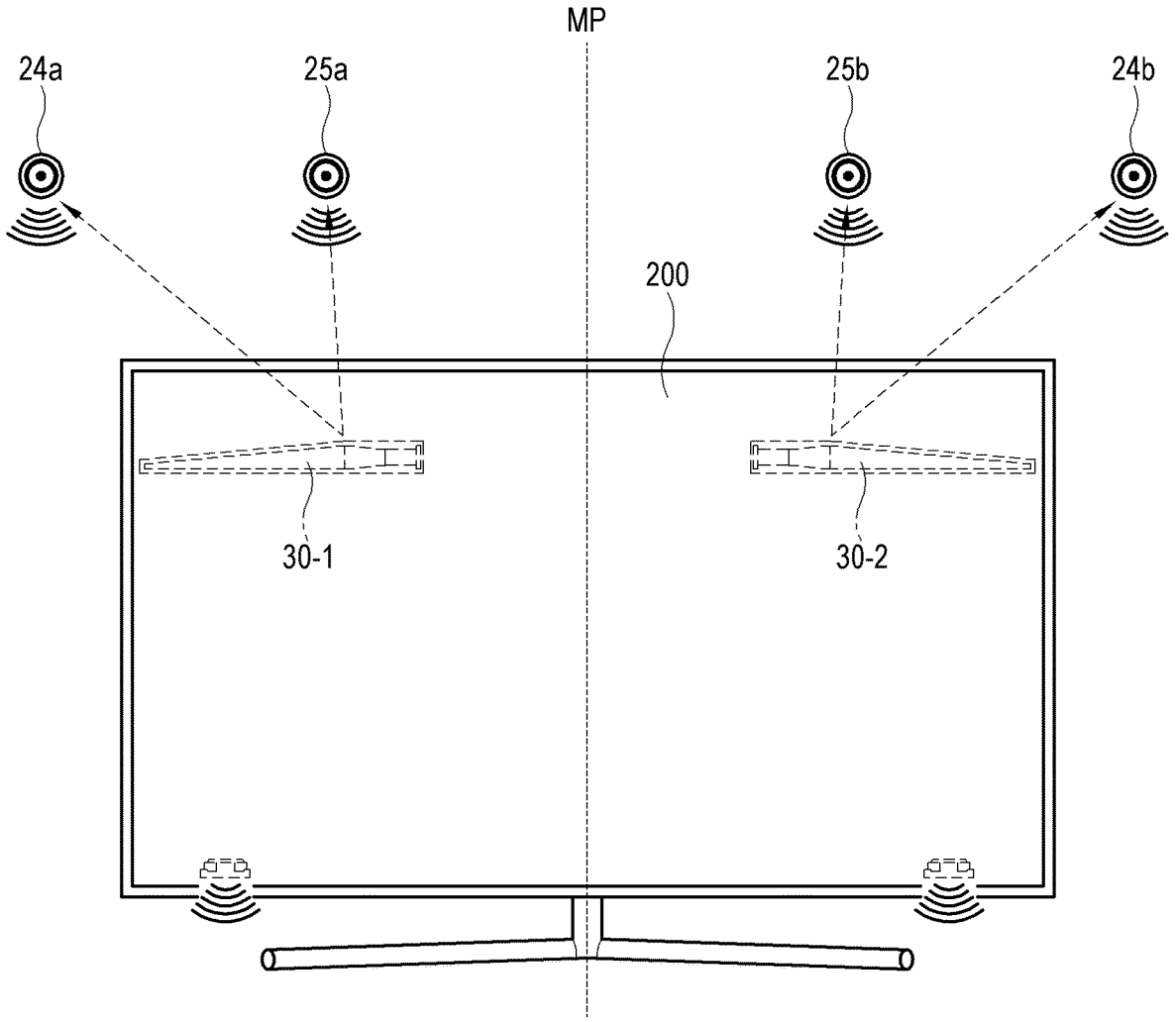
FIG. 12 is a view schematically illustrating emanating characteristics that vary according to frequency bands.

Therefore, the emanating characteristics varied depending on the frequency bands are schematized as shown in FIG. 12. Components lower than 2.2 kHz of the sound waves emanating from the directional speakers 30-1 and 30-2 arranged on the back of the display apparatus 200, are reflected from the ceiling at positions 25*a* and 25*b* next to a median plane. Further, components higher than 2.2 kHz of the sound waves are reflected from left and right lateral walls at positions 24*a* and 24*b* distant from the median plane MP.

In this case, the user 20 perceives that sounds are generated (i.e., virtual sound sources are present) at the positions from which the sounds are reflected.

The reflection positions 24*a* and 24*b* on the lateral walls may differ according to room environments. For example, the reflection positions 24*a* and 24*b* may be given within an angle of about 30~0 degrees toward the lateral directions. That is, an auditory image of a frequency lower than 2.2 kHz is reflected from the ceiling and becomes focused at a position near to the median plane, but an auditory image of a frequency higher than or equal to 2.2 kHz is reflected from the left and right lateral walls and becomes focused at a position rapidly distant from the median plane.

Meanwhile, the sound waves reflected from the rear wall are likely to mix with the sound waves of the omnidirectional speakers 30-3 and 30-4 since they emanate from the display apparatus 200 placed in front of the rear wall. Therefore, the effects of the sound waves emanating from the directional speakers 30-1 and 30-2 and reflected from the rear wall will be ignored in a re-panning process to be described below.

Eventually, an auditory image is not uniform but separated at a specific frequency band (e.g. 2.2 kHz), i.e., a frequency separation phenomenon occurs since propagation and reflection paths are different according to the frequencies. Such a non-uniform auditory image jumps up in some frequency ranges according to frequency changes. This may exert an adverse influence upon sound quality and a 3D-spatial audio effect, and also may increase user fatigue. For example, in a case of a scene where a frequency of a sound increases as time passes (e.g., as a vehicle passes by a user), the user 20 may feel a very unnatural sound as if an auditory image suddenly and spatially jumps up from a certain frequency. Therefore, a signal process according to an embodiment is implemented to remove such a non-uniform auditory image and increasing the size of a specific auditory image.

Figure 13:
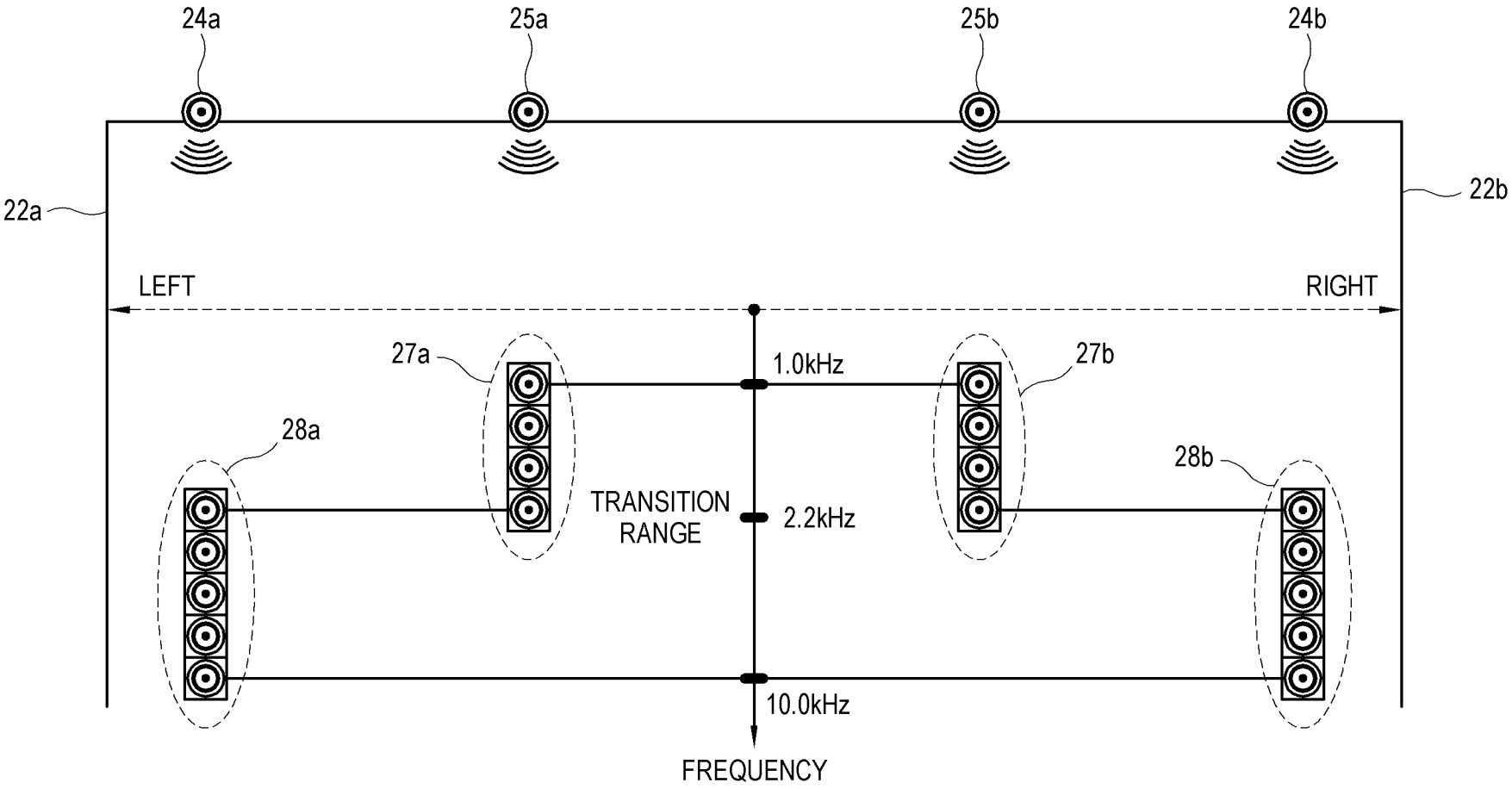
FIG. 13 is a schematic view illustrating a non-uniform auditory image according to frequency bands.

FIG. 13 is a schematic view illustrating a non-uniform auditory image according to frequency bands. Here, the axis of ordinates indicates the frequency, and the axis of abscissae indicates spatial left and right positions. It will be understood that the leftmost position indicates the left wall 22*a*, and the rightmost position indicates the right wall 22*b*.

Referring to FIG. 13, auditory images 27*a* and 27*b* of sound waves reflected at positions 25*a* and 25*b* close to a median plane have a low frequency band of 1.0~2.2 kHz and are formed in the close positions 25*a* and 25*b* regardless of the frequency. Further, auditory images 28*a* and 28*b* of sound waves reflected from positions 26*a* and 26*b* distant to the median plane have a high frequency band of 2.2~10 kHz and are formed in the distant positions 26*a* and 26*b* regardless of the frequency. Therefore, a sound corresponding to a transition range around 2.2 kHz may have a frequency separation phenomenon.

Figure 14:
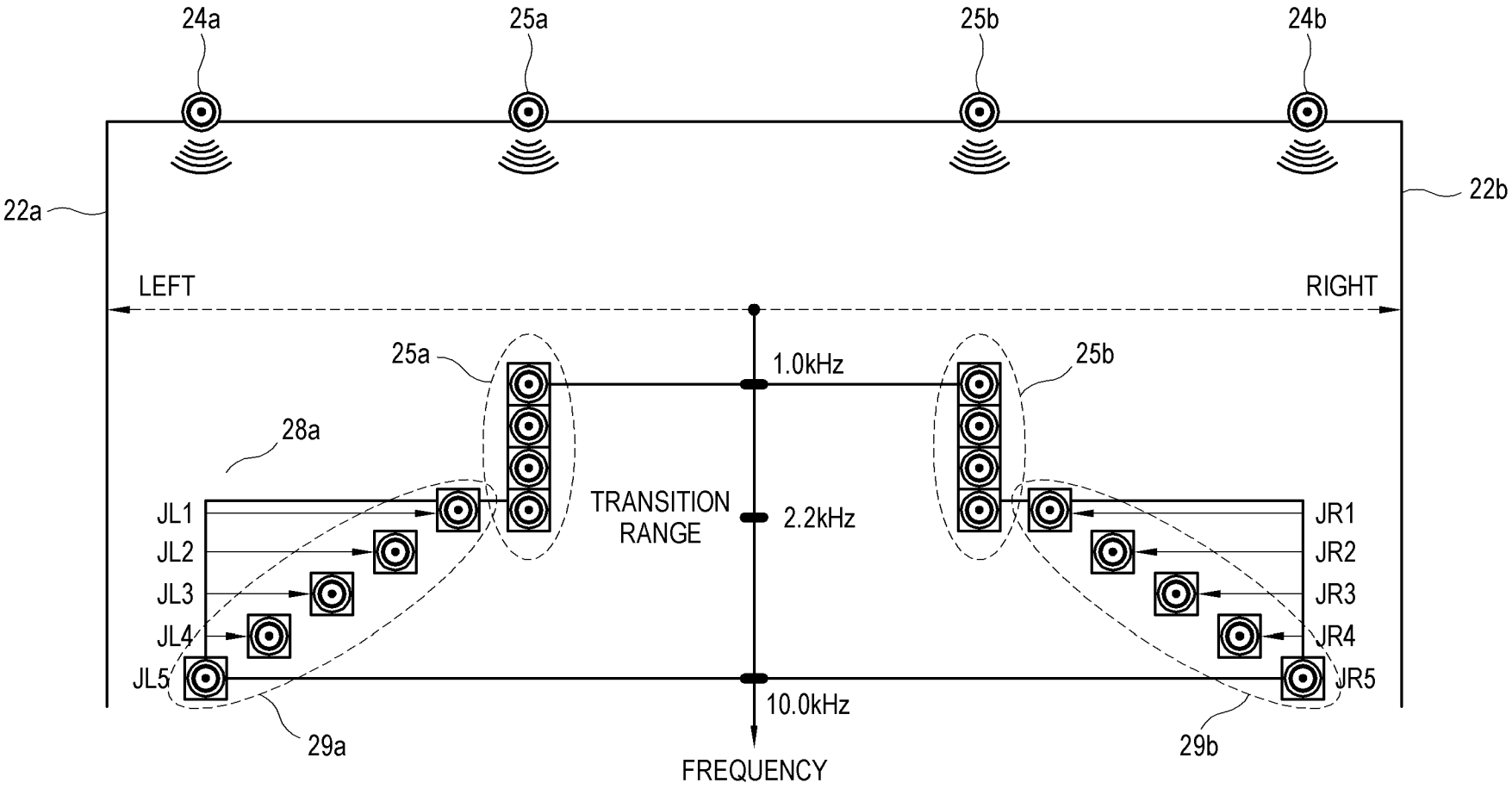
FIG. 14 is a schematic view illustrating an example of performing re-panning to provide a uniform auditory image within an adjustment frequency range, according to an embodiment.

FIG. 14 is a schematic view illustrating an example of performing re-panning to provide a uniform auditory image within an adjustment frequency range, according to an embodiment. As compared to FIG. 13, the position of the auditory image is not changed in the low frequency band of 10~2.2 kHz, but greater adjustment values JR1 to JR5, JL1 to JL5 for re-panning are given as the frequency becomes lower in the high frequency band of 2.2~10 kHz. Thus, the auditory image is not separated even in the transition range around 2.2 kHz. The adjustment frequency range refers to a range to which the re-panning is applied, and FIG. 14 shows an adjustment frequency range of 2.2~10 kHz by way of example. The reason why the re-panning is not applied to the low frequency band of 10~2.2 kHz is because the directionality of the sound wave having a low frequency is low and the re-panning is not as important as the auditory image is actually formed around the media plane, i.e., in the vicinity of the display apparatus 200. Further, the reason why the re-panning is not applied to the frequency band of 10 kHz or higher is because there is a limit to the panning due to the left wall 22*a* and the right wall 22*b* of the room environment, and excessive panning causes poor sound quality.

As described above, the adjustment frequency range may be defined by a lower limit frequency and an upper limit frequency. It is understood, however, that one or more other embodiments are not limited thereto. For example, according to another embodiment, the adjustment frequency range may be defined without either of the lower limit frequency or the upper limit frequency. Most extremely, the full audible frequency range of 0.02~20 kHz may be set as the adjustment frequency range.

In general, a process of changing a certain position, at which an auditory image (i.e., a virtual source) is formed, by adjusting a channel gain of a plurality of speakers (e.g. left and right speakers for 2 channels) may be referred to as panning adjustment or re-panning. Below, a process of adjusting the channel gain to prevent the auditory image from being separated at a specific frequency as shown in FIG. 14 will be inclusively called the re-panning.

Figure 15:
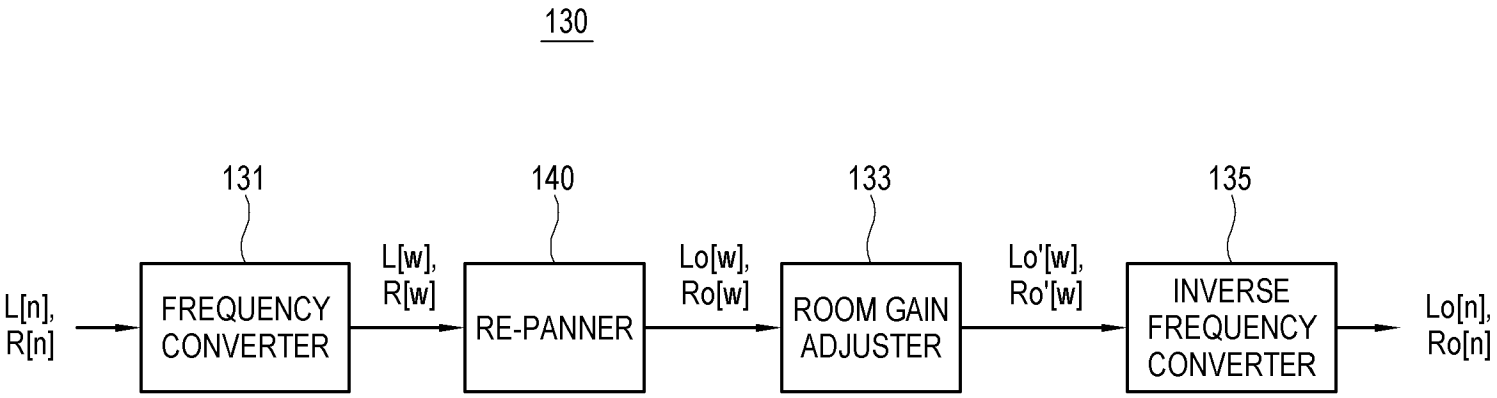
FIG. 15 is a view illustrating a configuration of a signal processor in more detail according to an embodiment.

FIG. 15 is a view illustrating a configuration of a signal processor 130 in more detail according to an embodiment. The signal processor 130 may be materialized or embodied by an integrated circuit, e.g., a digital signal processor (DSP), but not limited thereto. Alternatively, the signal processor 130 may be achieved or embodied (at least in part) by a software program or computer-readable instructions that are loaded into a system memory and executed by the processor 10.

The signal processor 130 may include a frequency converter 131, a re-panner 140, a room gain controller 133, and an inverse frequency converter 135.

The frequency converter 131 converts two or more channel signals (i.e. multi-channel signals) generated in the channel processor 110 (see, e.g., FIG. 2) by time-frequency conversion, thereby generating a channel signal of a frequency domain. The channel signal may have a discrete value as a sampling waveform and, thus, discrete Fourier transform may be used for the time-frequency conversion. Alternatively, fast Fourier transform (FFT), discrete cosine transform (DCT), discrete sine transform (DST), and/or the like time-frequency conversion technique may be used.

For example, when the DFT is applied to the levels of two channels L and R with respect to an nth audio sample in a time domain, the levels of the two channels L and R may be represented by the following Expression 1.

$$L(w)=Dft(L[n]),R(w)=Dft(R[n]) \quad \text{[Expression 1]}$$

where n is an audio sample number, w is a frequency band, L(n) is the level of the left channel in the time domain, R(n) is the level of the right channel in the time domain, L(w) is the level of the left channel in the frequency domain, and R(w) is the level of the right channel in the frequency domain.

The re-panner 140 changes a channel gain by as much as a corresponding adjustment value with regard to a channel signal in the frequency domain, which belongs to the adjustment frequency value, among generated channel signals in the frequency domain. In this case, the adjustment value may be at least partially vary (or be variably determined) according to frequencies that the channel signal of the frequency domain has. According to an embodiment, the adjustment value may be set (or determined) to decrease as the frequency that the channel signal of the frequency domain has becomes higher (see FIG. 14).

Alternatively, without limitations, the adjustment value may be set to increase as the frequency the channel signal of the frequency domain becomes higher. In FIG. 13, when a low-frequency auditory image position 25*b* and a high-frequency auditory image position 24*b* are considerably close to each other thereby resulting in most of the channel signals to be close to and focused on one point rather than separation of the auditory image, the adjustment value is set to be greater and panned more rightward as the frequency of the channel signal becomes higher at the high-frequency auditory image position 24*b*.

In this manner, the re-panner 140 may set the adjustment value for the channel signal of the frequency domain, which belongs to the adjustment frequency domain, to be subjected to monotonic change as the frequency becomes higher. The monotonic change includes monotonic increase and monotonic decrease. Here, the monotonic increase of the adjustment value refers to a pattern where the adjustment value is constant or increases without a decreasing section as the frequency becomes higher. Likewise, the monotonic decrease of the adjustment value refers to a pattern where the adjustment value is constant or decreases without an increasing section as the frequency become higher. As an example pattern of the monotonic change, there is a linear pattern as shown in FIG. 14. Alternatively, other curved patterns are possible as long as there are no sections that change in an opposite direction to the monotonic change.

As described above with reference to FIG. 13, the position of the auditory image formed by the sounds emanating from the directional speakers 30-1 and 30-2 include the low-frequency auditory image positions 25*a* and 25*b* and the high-frequency auditory image positions 24*a* and 24*b*. In this case, the high-frequency auditory image positions 24*a* and 24*b* are positioned more distant than the low-frequency auditory image positions 25*a* and 25*b* with respect to the median plane.

The adjustment frequency range, to which the re-panning is applied, may be variously set between the lowest frequency (2.2 kHz) and the highest frequency (10 kHz) among the frequencies (2.2~10 kHz) of the sound emanating at the high-frequency auditory image positions 24*a* and 24*b*. Alternatively, and without limitations, the adjustment frequency range may be set to be wider or narrower than the lowest frequency and the highest frequency in accordance with actual listening environments.

The adjustment value according to frequency bands used in the re-panning is applied to each of the left channel signal and the right channel signal among the channel signals of the frequency domain, so that the sum of channel gain changed for the left channel signal and the channel gain changed for the right channel signal can be kept constant (linear panning), and the sum of squares can be kept constant (pairwise constant power panning). More detailed operations of the re-panner 140 will be described below with reference to FIG. 17.

Referring back to FIG. 15, the room gain controller 133 applies different room gains or parameter equalizations (EQ) according to the frequency bands before the channel signals are all subjected to inverse frequency conversion. Sounds reflected from a ceiling and a lateral wall in an interior space are transmitted to a user in different directions. In this case, the room gain control and/or the parameter EQ are implemented to make up for change in frequency power transmitted to the directional speakers 30-1 and 30-2 due to the transmission path length difference and directions. To this end, binaural recording information obtained by a free-field microphone, a dummy head or the like measurement device may be used to determine a room gain (or an EQ parameter), and the determined room gain is applied as it is multiplied with the channel signal ($L_o(w)$, $R_o(w)$) provided by the re-panner 140.

Figure 16:
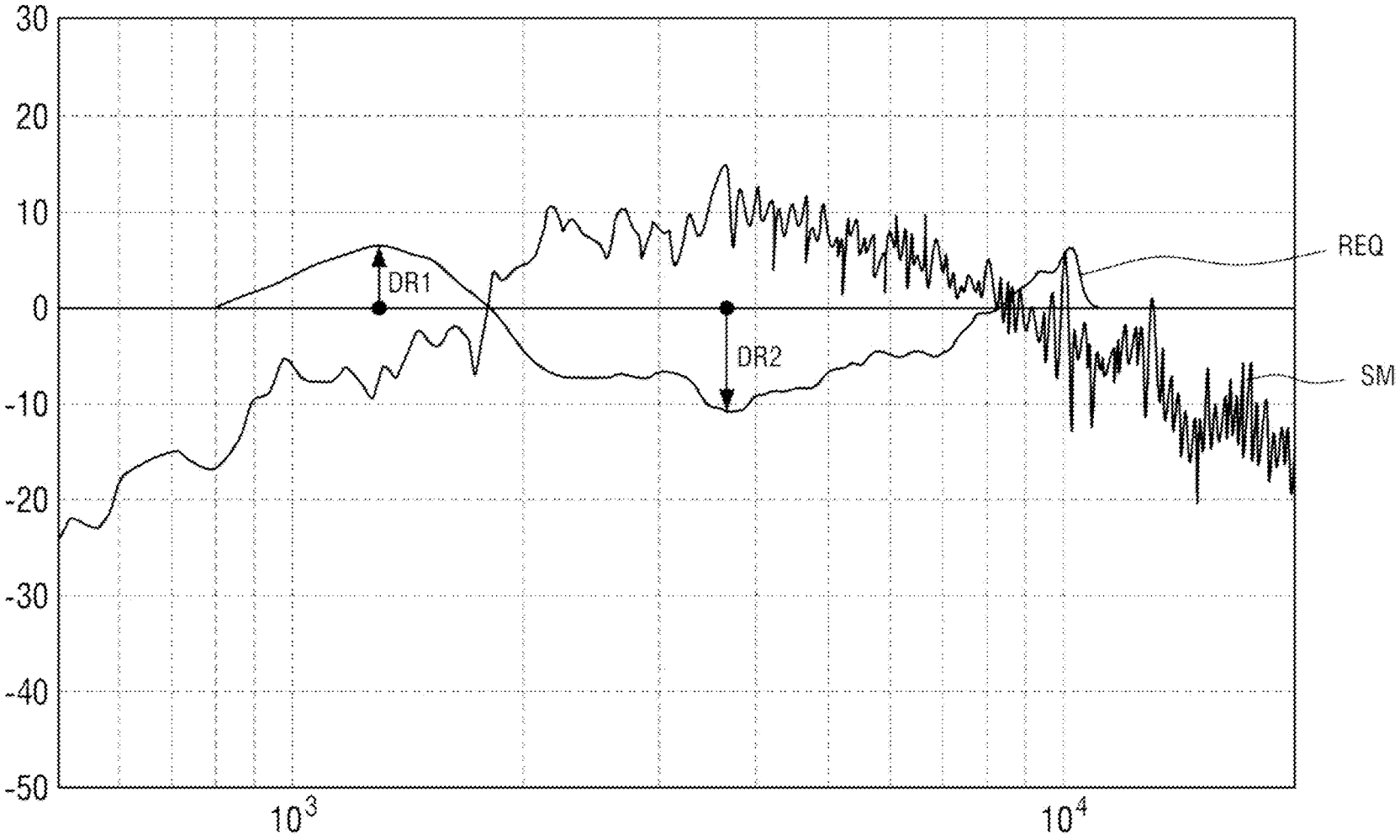
FIG. 16 is a graph showing a signal measured within a room by a measurement device and a room gain corresponding to the measured signal.

For example, as shown in FIG. 16, a signal SM measured by a measurement device has a gain that varies depending on frequencies, in accordance with room environments or positions of a user. Here, the axis of abscissae indicates a frequency (Hz), and the axis of ordinates indicates a gain value (dB) of a specific channel signal. As can be seen, the measured signal SM changes up and down according to the frequencies with respect to a zero gain. It is therefore possible to adjust a room gain REQ according to the frequencies so as to become the zero gain within the full frequency band. In the example shown in FIG. 16, an average measured signal SM and room gains DR1, DR2, etc., having opposite amplitudes are applied to the full frequency band, thereby obtaining a flat zero gain.

The adjustment of the room gain utilizes the free-field microphone, the dummy head, or the like measurement device and varies depending on a user's position since the adjustment is based on real-time measurements depending on a user's position and room environments. In one or more other exemplary embodiments, the adjustment of the room gain may be omitted from the whole signal process.

The levels $L_o'[w]$ and $R_o'[w]$ of two or more channels, which are adjusted by the room gain controller 133, or the levels $L_o[w]$ and $R_o[w]$ of two or more channels, which are output from the re-panner 140 without the room gain controller 133, are provided to the inverse frequency converter 135. The inverse frequency converter 135 applies the inverse frequency conversion to the provided channel signal or the levels of the channel, thereby restoring the channel signal of the time domain. The channel signal of the time domain may be two surround signals $L_o[n]$ and $R_o[n]$ to be output to the directional speakers 30-1 and 30-2. The channel signal to be converted by the inverse frequency converter 135 into that of the time domain may, for example, be the channel signal of the full frequency range including not only frequency components, of which the channel gain is changed by the re-panner 140, but also frequency components of which the channel gain is not changed. As a result, the channel signals $L_o[n]$ and $R_o[n]$ output from the inverse frequency converter 135 are provided to the signal distributor 150 (see FIG. 2), and the signal distributor 150 distributes the channel signals $L_o[n]$ and $R_o[n]$ to the plurality of directional speakers 30-1 and 30-2.

Figure 17:
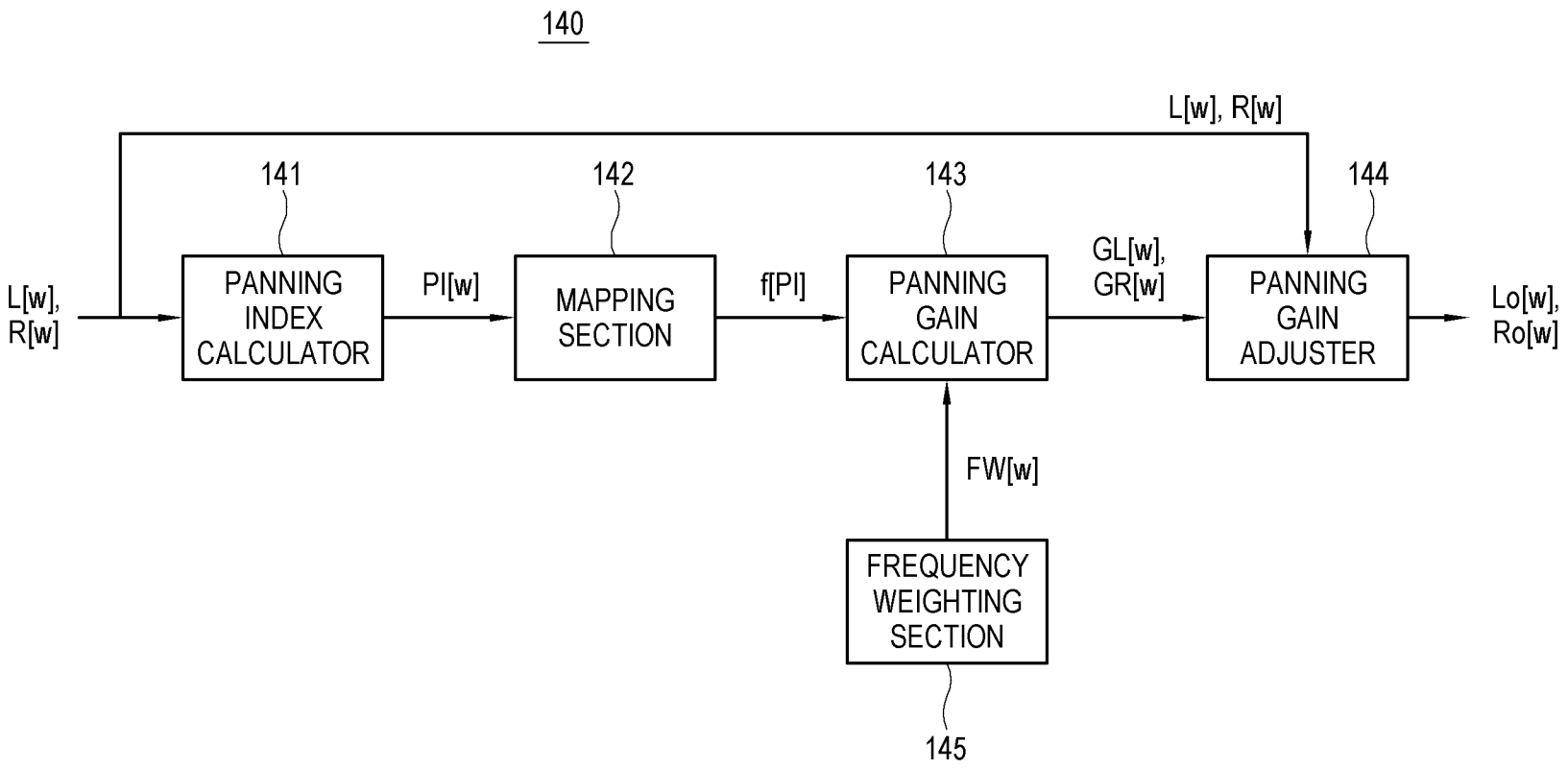
FIG. 17 is a block diagram illustrating a configuration of a re-panner of FIG. 15 in more detail.

FIG. 17 is a block diagram illustrating a configuration of the re-panner 140 of FIG. 15 in more detail. The re-panner 140 includes a panning index calculator 141, a panning gain calculator 143, a panning gain controller 144, a mapping section 142, and a frequency weighting section 145. In one or more other exemplary embodiments, the mapping section and/or the frequency weighting section 145 may be omitted.

The panning index calculator 141 may calculate a panning index corresponding to a frequency band on the basis of a level ratio between a left channel signal and a right channel signal among channel signals of the frequency domain. According to one or more other embodiments, a coherence component ratio between the left and right channel signals, a cross-spectral density function, an auto-spectral density function, or the like may be employed in defining the panning index.

The panning index has values within a predetermined range, and refers to an index for indicating a position of a virtual sound source, i.e., a position of an auditory image in accordance with a level ratio between the left channel signal and the right channel signal. Conceptually, the panning index refers to an angle for indicating a position of an auditory image between a left channel and a right channel. For example, on the assumption that the panning index has a value ranging between −1 and 1, a sound is output from only the left channel when the panning index is −1, and a sound is output from only the right channel when the panning index is 1. Further, in the present example, the frequency band power of the left channel is equal to the frequency band power of the right channel when the panning index is 0.

According to an embodiment, the panning index calculator 141 calculates a panning index PI[w] based on a level ratio between a left channel signal L[w] and a right channel signal R[w] by the following Expression 2.

$$PI[w] = \frac{R[w]^2 - L[w]^2}{R[w]^2 + L[w]^2} = \frac{r^2 - 1}{r^2 + 1} \quad \text{[Expression 2]}$$

where w is a frequency band, r=R[w]/L[w], $L[w]^2$ is a frequency band power of a left channel signal, and $R[w]^2$ is a frequency band power of a right channel signal. Since PI[w] is normalized by dividing a difference between frequency band powers of both of the channels by the sum of frequency band powers, the panning index has a value between −1 and 1. In the Expression 2, the panning index increases as the frequency band power of the right channel signal becomes relatively great. However, this is a matter of notation. Thus, when R[w] and L[w] are exchanged, the panning index may increase as the frequency band power of the left channel signal becomes relatively great.

The mapping section 142 applies a mapping function (f(x)) to the panning index PI calculated in the panning index calculator 141 so that the panning index can be adjusted and then provided to the panning gain calculator 143. According to an embodiment, the mapping function may be omitted at times or in certain implementations. When applied, however, there is an effect on amplifying or reducing a difference between the left and right channel signals at a specific frequency band w when the mapping function.

Figure 18:
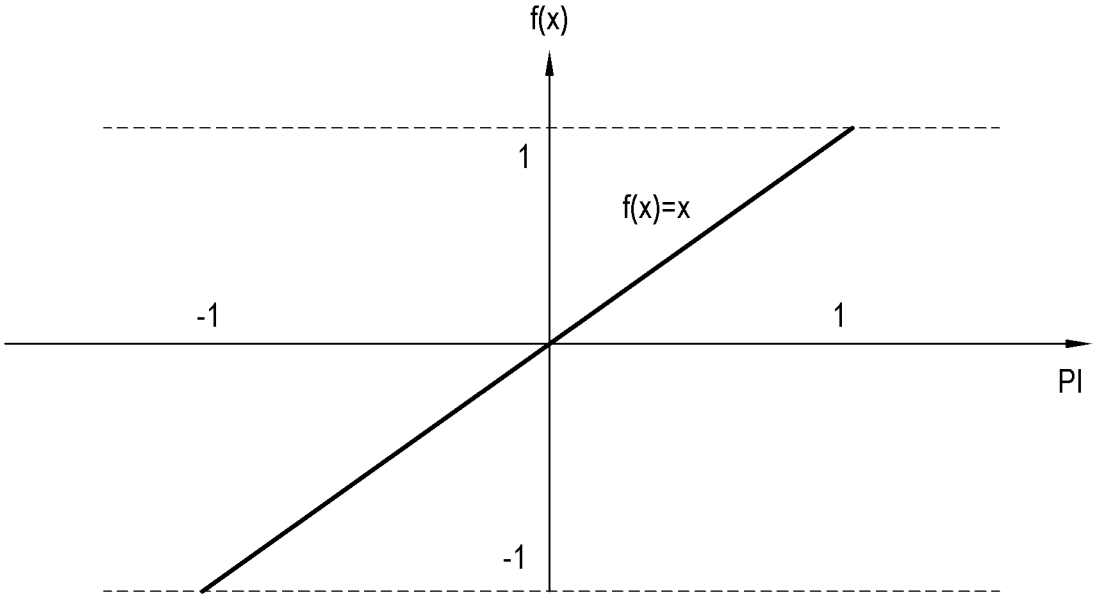
FIGS. 18 and 19 are graphs showing examples of a mapping function.

FIG. 18 is a graph showing an example of a mapping function where an input PI is equal to an output f(x). Here, the axis of abscissae indicates the panning index PI, and the axis of ordinates indicates results of the mapping function f(x). As can be seen, when the completely proportional mapping function is applied within the numerical value range of the panning index PI, the result is the same as when the mapping function is not applied. However, when the mapping function is transformed into a curved line type, an effect on amplifying and/or reducing the difference between the left and right channel signals is exerted as described above.

Figure 19:
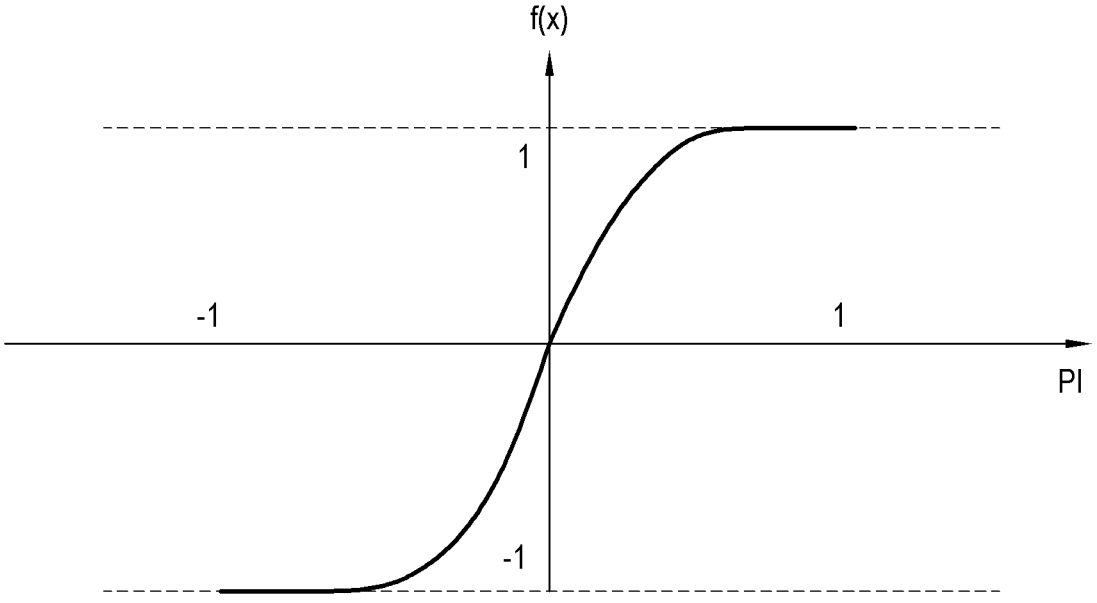

FIG. 19 is a graph showing an example of the mapping function where the output f(x) is amplified as compared with the input PI. In the graph of FIG. 19, the output f(x) relatively suddenly increases or jumps while the panning index PI increases from 0 to 1, and is saturated at f(x)=1. Therefore, in this case, a higher value is output with respect to the same panning index PI, thereby exerting more panning effects, i.e., more effects on moving the auditory image.

Referring back to FIG. 17, the panning gain calculator 143 applies a specific panning scheme on the panning index to calculate the channel gain GL[w] changed with regard to the left channel signal and the channel gain GR[w] changed with regard to the right channel signal. The panning gain calculator 143 provides the calculated gains to the panning gain controller 144. As the panning scheme for calculating such a panning gain, there are linear panning, pairwise constant power panning, vector-based amplitude panning (VBAP), and the like various schemes.

Figure 20:
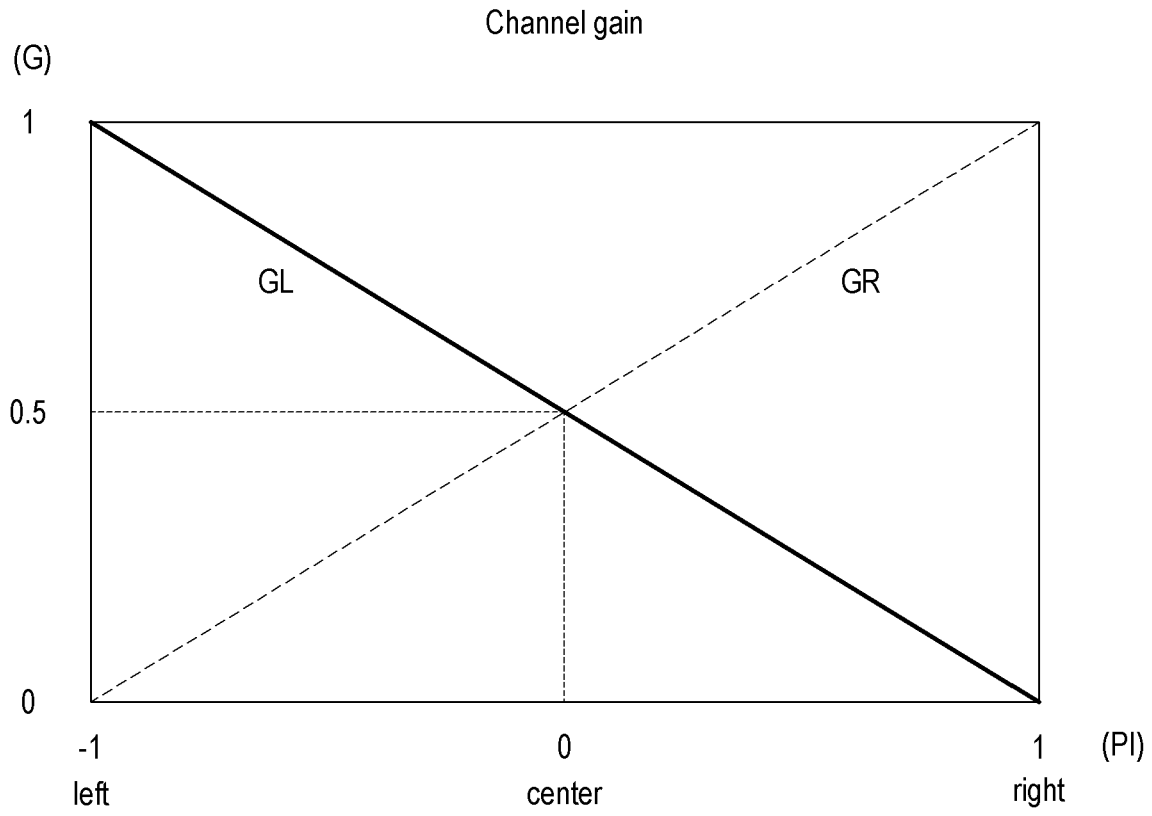
FIGS. 20 and 21 are graphs respectively showing a channel gain and power in linear panning.
Figure 21:
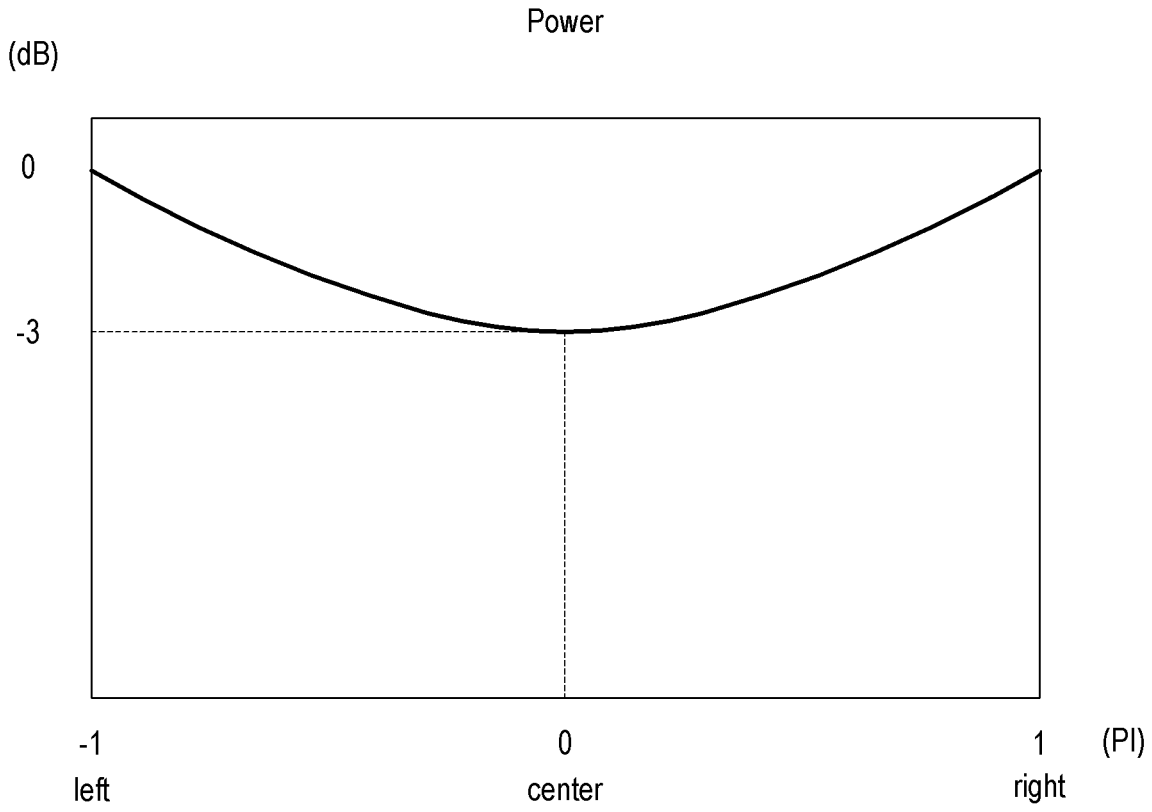

The linear panning scheme will be described with reference to FIGS. 20 and 21. In FIGS. 20 and 21, the axis of abscissae indicates a panning index PI or a panning position where an auditory image is formed. Further, the axes of ordinate in FIG. 20 indicates a channel gain and the axes of ordinate in FIG. 21 indicates power.

As shown in FIG. 20, the channel gain GL of the left channel signal and the channel gain GR of the right channel signal are linearly increased and decreased as the panning index PI changes. Therefore, the panning gain can be calculated by a simple expression or equation because the sum of left and right channel gains of the auditory image formed at a certain position PI is constant at 1. However, as shown in FIG. 21, power varies and has a minimum level, i.e. −3 dB, in the median plane (PI=0). Therefore, it is unnatural since the output becomes lower when the auditory image moves near the median plane.

The following Table 1 shows an example in which the channel gains GL and GR are calculated by applying such a simple linear panning scheme to the right auditory images 27*b* and 28*b* under the condition that the auditory image is bisected as shown in FIG. 13. Here, JR indicates an adjustment value, i.e., a difference between the channel gain before the change and the channel gain after the change.

TABLE 1

| | GL | GR | JR |
|---|---|---|---|
| 1.0 kHz | 0.1 | 0.9 | 0 |
| 1.5 kHz | 0.1 | 0.9 | 0 |
| 2.0 kHz | 0.1 | 0.9 | 0 |
| 3.0 kHz | 0.4 | 0.6 | 0.3 |
| 4.0 kHz | 0.3 | 0.7 | 0.2 |
| 6.0 kHz | 0.2 | 0.8 | 0.1 |
| 8.0 kHz | 0.1 | 0.9 | 0 |

Here, it will be assumed that the adjustment frequency range is 2.2~10 kHz as described above, and the gain of the left channel and the gain of the right channel before being subjected to the panning are respectively constant at 0.1 and 0.9 regardless of the frequency.

First, a frequency range lower than or equal to 2.0 kHz does not belong to the adjustment frequency range and the panning is not performed. Therefore, the left channel gain GL and the right channel gain GR are respectively constant at 0.1 and 0.9 at frequencies of 1.0, 1.5 and 2.0 kHz. On the other hand, at a frequency range higher than or equal to 3.0 kHz, the channel gain is controlled to be adjusted, i.e., increased or decreased by as much as the corresponding adjustment value JR by the foregoing linear panning. For example, the adjustment values JR are 0.3, 0.2, 0.1 and 0.0 at frequencies of 3.0, 4.0, 6.0, 8.0 kHz, respectively. At any frequency before and after the adjustment, the sum of the left channel gain GL and the right channel gain GR is constant at 1.

It will be understood that a higher adjustment value is applied as the frequency becomes lower within the adjustment frequency range. In light of the panning scheme, when the decreasing width of the channel gain of the right channel signal and the increasing width of the channel gain of the left channel signal are large, this means that the auditory image at the specific frequency moves from a right channel to a left channel. Therefore, as shown in FIG. 14, the auditory image is prevented from being bisected in a transition range around 2.2 kHz, and it is possible to get more natural sound quality even though the frequency varies.

Next, the pairwise constant power panning scheme will be described with reference to FIGS. 22 and 23.

Figure 22:
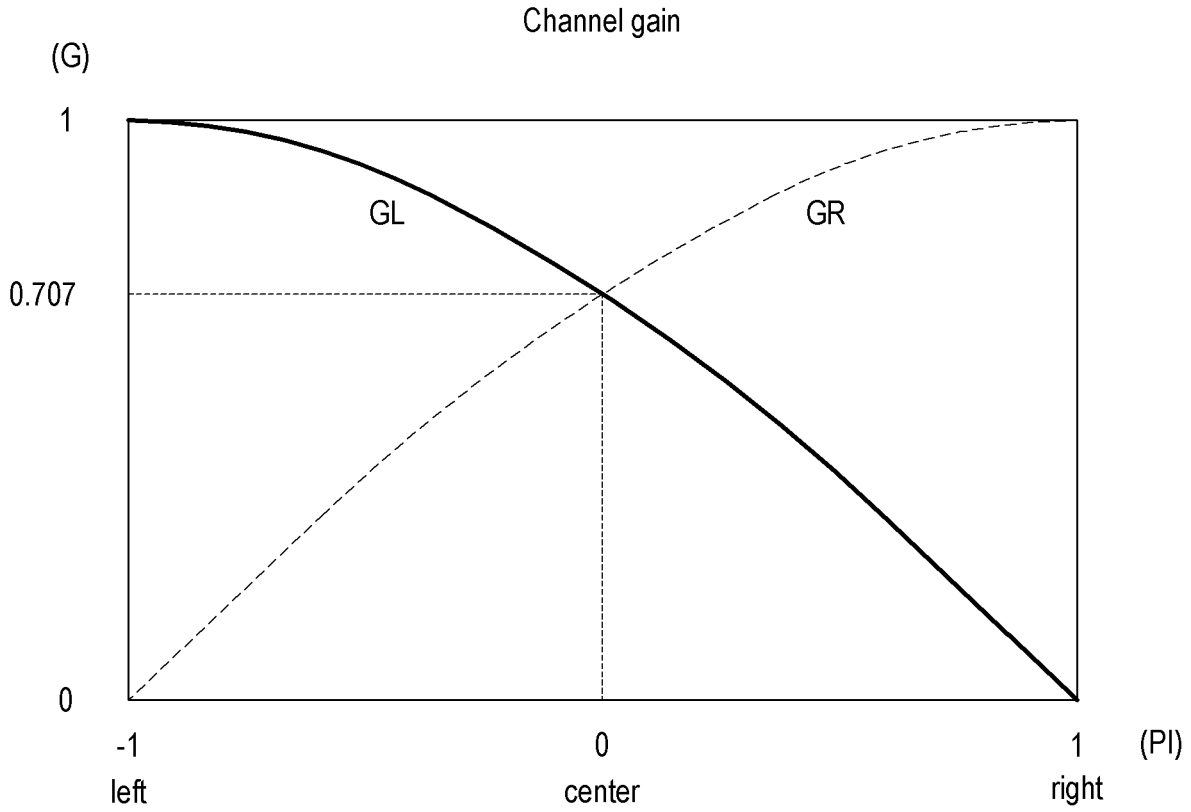
FIGS. 22 and 23 are graphs respectively showing a channel gain and power in pairwise constant power panning.
Figure 23:
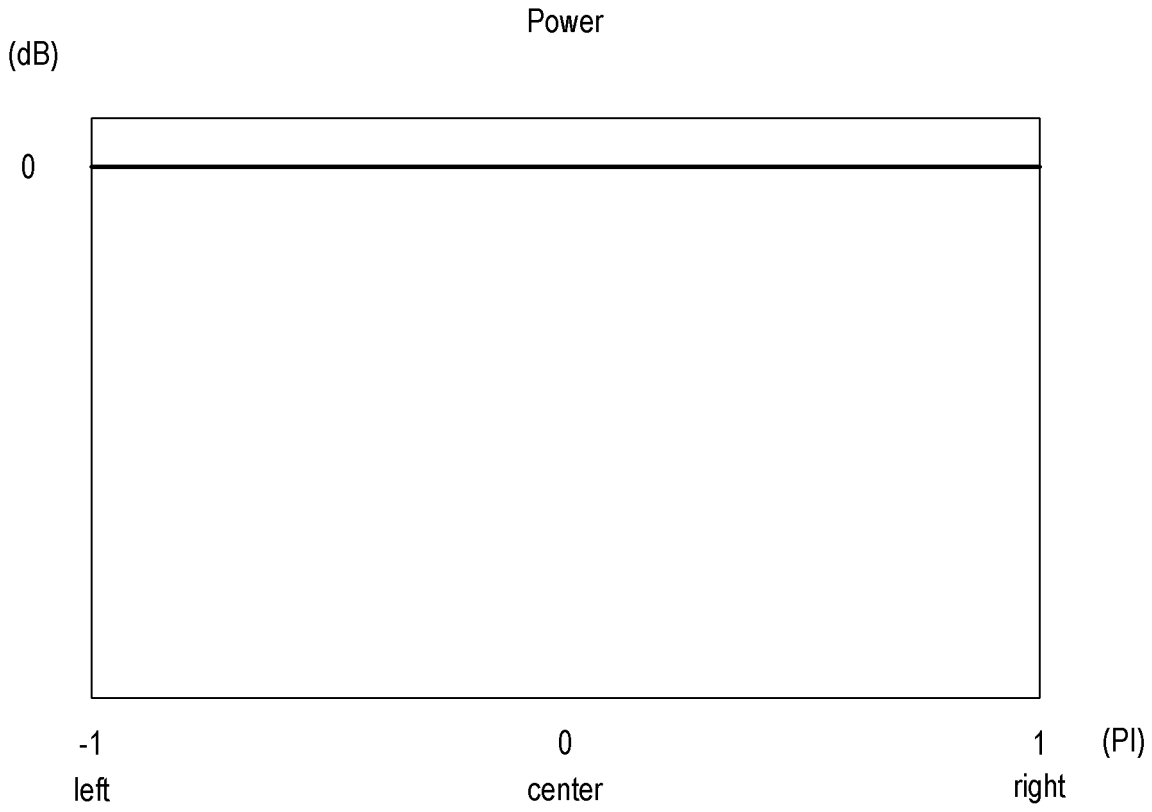

In FIGS. 22 and 23, the axis of abscissae indicates a panning index PI or a panning position where an auditory image is formed. Further, the axes of ordinates in FIG. 22 indicates a channel gain and the axes of ordinates in FIG. 23 indicates power.

Referring to FIG. 22, the channel gain GL of the left channel signal and the channel gain GR of the right channel signal are increased and decreased in the form of a trigonometric function such as sine and cosine as the panning index PI changes. Total power of the channel signal is generally calculated by the sum of a square of GL and a square of GR. Due to the characteristics of the trigonometric function, as shown in FIG. 23, the power is kept at 0 dB regardless of the position of the auditory image to panned.

Figure 24:
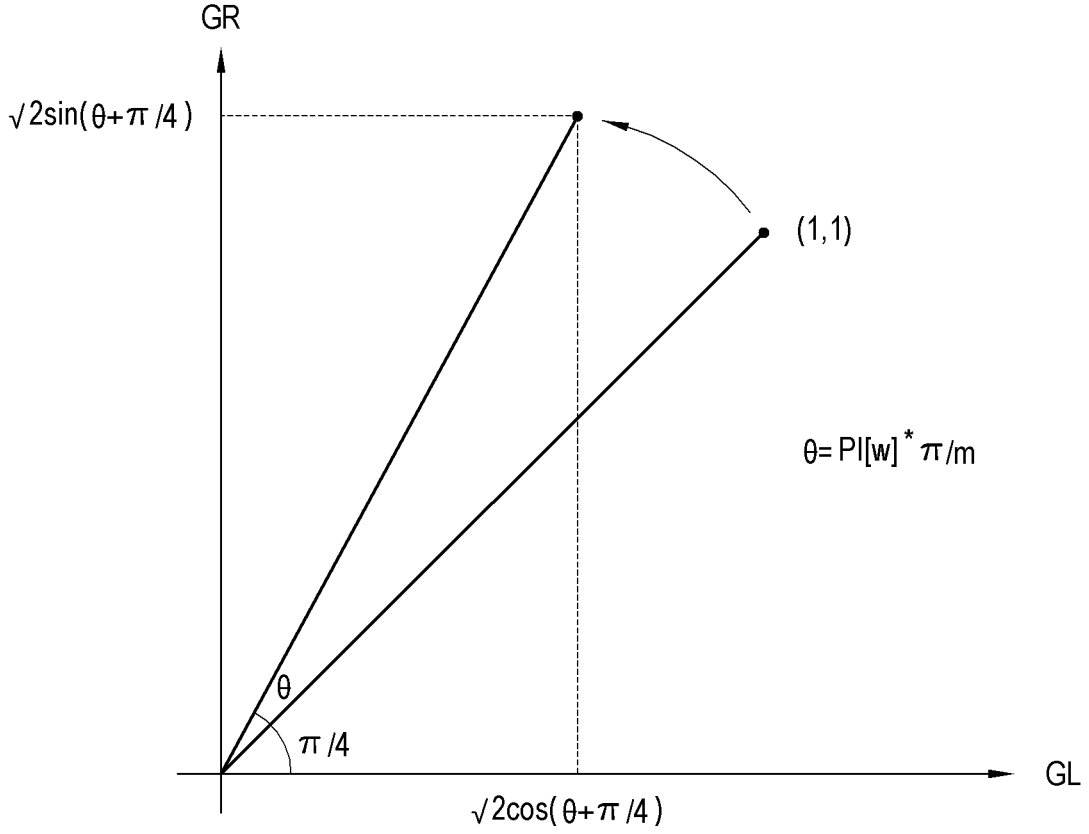
FIG. 24 is a schematic view illustrating a position based on rotary translation in cosine/sine panning.

In accordance with the panning based on the trigonometric function, when a position of $\pi/4$, i.e., 45°, is set as a reference position, as shown in FIG. 24, the channel gains GR and GL can be calculated by the following Expression (i.e., equation) 3.

$$GL[w] = \cos\left(PI[w] * \frac{\pi}{m}\right) - \sin\left(PI[w] * \frac{\pi}{m}\right) = \sqrt{2}\ \cos\left(PI[w] * \frac{\pi}{m} + \frac{\pi}{4}\right) \quad \text{[Expression 3]}$$

$$GR[w] = \cos\left(PI[w] * \frac{\pi}{m}\right) + \sin\left(PI[w] * \frac{\pi}{m}\right) = \sqrt{2}\ \sin\left(PI[w] * \frac{\pi}{m} + \frac{\pi}{4}\right)$$

where the sum of a square of GR[w] and a square of GL[w], which shows the power, is constant at 2. Further, m is a natural number greater than 2, which may be varied depending on the positions of the left and right speakers with respect to a user's position. For example, m is 4 when the left and right speakers are arranged to form an angle of 90° with respect to the user.

As another panning scheme, the VBAP may be used. The foregoing pairwise constant power panning employs the trigonometric function to keep the power constant. Although it is known that a virtual source panned along sine and cosine values is generally matched with psychological recognition, its theoretical basis has not been clearly provided. To provide the theoretical basis, the VBAP uses vectors to represent a position of a virtual source and positions of speakers, and makes the sum of the vectors be the position of the virtual source.

Figure 25:
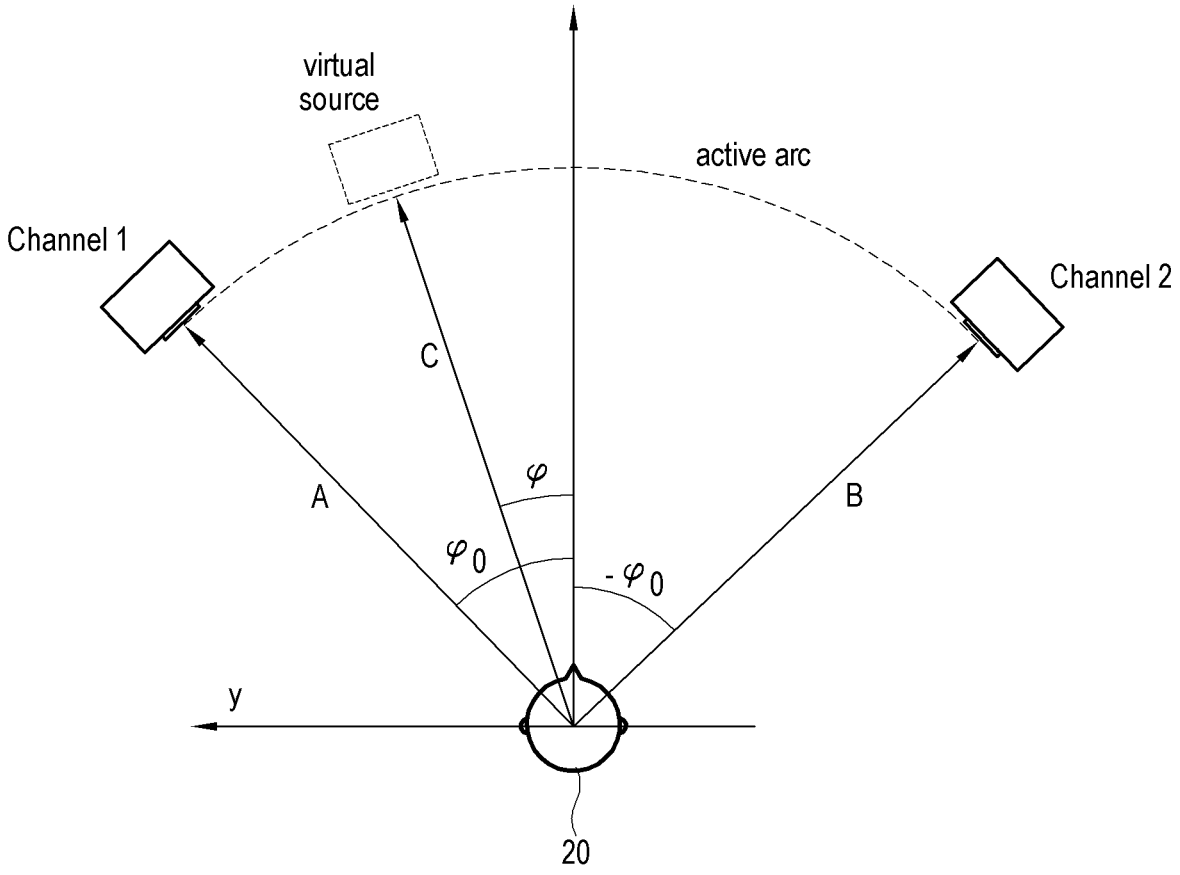
FIG. 25 is a schematic view illustrating a relationship between a virtual source vector and two channel vectors in vector-based amplitude panning (VBAP)

As shown in FIG. 25, three vectors are defined in the VBAP. The three vectors include a vector A connecting a speaker of a left channel (channel 1) and a user 20, a vector B connecting a speaker of a right channel (channel 2) and the user 20, and a vector C connecting a position of a virtual source defined by the vector A and the vector B and the user 20.

In the present example, it is assumed that the head of the user 20 has coordinates (0,0), the vector A has coordinates ($a_x$, $a_y$), and the vector B has coordinates ($b_x$, $b_y$). In this case, the coordinates ($c_x$, $c_y$) of the vector C, which represents the position of the virtual source (i.e., the position of the auditory image), are defined by the following Expression 4. Here, GL is a channel gain of a left channel, and GR is a channel gain of a right channel.

$$C(c_x, c_y) = GL * A(a_x, a_y) + GR * B(b_x, b_y) \quad \text{[Expression 4]}$$

Since the vectors A, B and C are all given, it is possible to obtain GL and GR from the Expression 4. GL and GR accurately represent a direction of a certain vector C but are varied in power according to directions. Therefore, normalization is additionally performed as shown in the following Expression 5.

$$GL' = \frac{GL}{\sqrt{GL^2 + GR^2}} \qquad GR' = \frac{GR}{\sqrt{GL^2 + GR^2}} \quad \text{[Expression 5]}$$

GL' and GR' obtained as described above form the vector C moving along an active arc connecting two speakers. According to the VBAP scheme, the panning for the auditory image is achieved independently of the position of the speaker. Even when the positions of the speakers are changed, it is possible to obtain GL and GR by changing only the information about the vectors A and B in the Expression 4.

Referring back to FIG. 17, the channel gains GL[w] and GR[w] obtained by the panning gain calculator 143 according to the frequency bands are provided to the panning gain controller 144. The panning gain controller 144 multiplies the channel signals L[w] and R[w] of the frequency domain first input to the re-panner 140 with the channel gains GL[w] and GR[w], respectively, and thereby outputs the output channel signals $L_o$[w] and $R_o$[w], i.e., the rendered signals, to the signal distributor 150.

Meanwhile, the panning gain calculator 143 may additionally consider a frequency weight to more accurately calculate the panning gain. The frequency weighting section 145 applies the frequency weight to the panning index to reduce a panning effect in a frequency band higher than or equal to a specific frequency, and then provides the panning index, to which the frequency weight is applied, to the panning gain calculator 143. When the characteristics of the directional speaker are taken into account, it may not be suitable to apply the panning effect up to the frequency band higher than or equal to a specific frequency.

Figure 26:
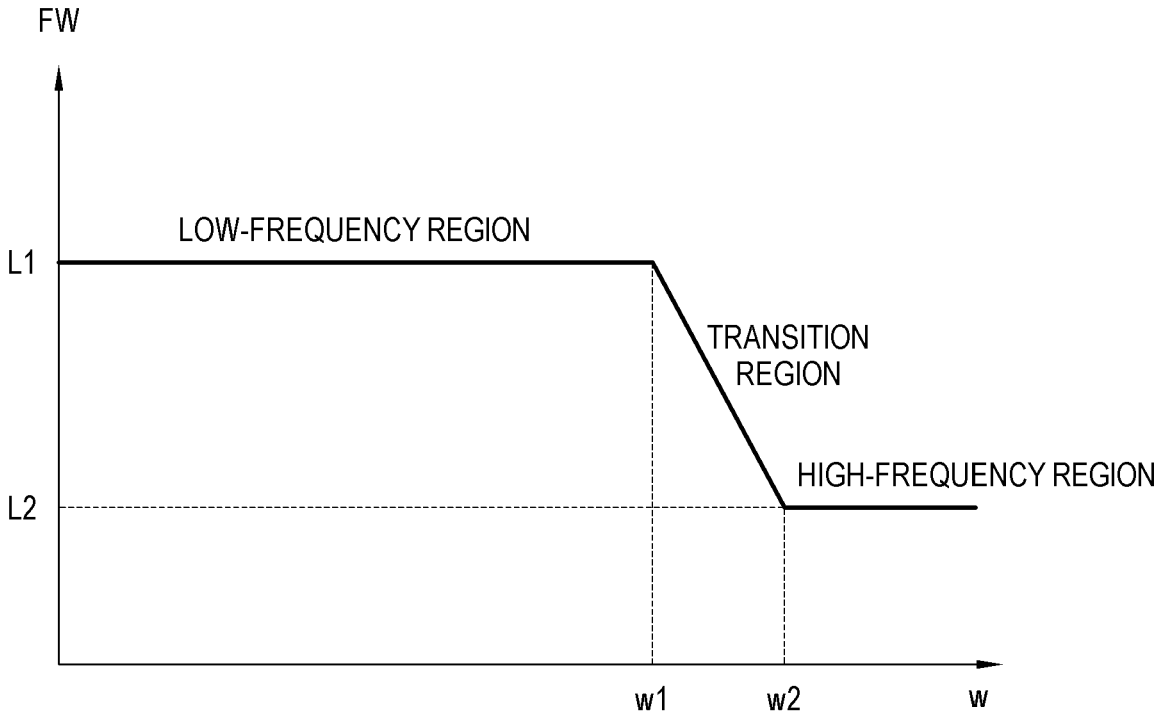
FIG. 26 is a graph showing an example of a frequency weighting function.

For example, a frequency weighting function FW[w] for such a frequency weight may be provided as shown in FIG. 26. The frequency weighting function FW[w] includes a low frequency region where a first level L1 is constant, a high frequency region where a second level L2 lower than the first level L1 is constant, and a transition region where a transition is made from the first level L1 to the second level L2 between the low frequency region and the high frequency region. The three regions are divided by frequency thresholds w1 and w2.

In this manner, when the frequency weight FW[w] is provided to the panning gain calculator 143, the panning gain calculator 143 can reflect the frequency weight in obtaining the channel gain. While calculating and obtaining the panning gain, the panning index PI[w] may be replaced by PI'[w] by being multiplied with the frequency weight as shown in the following Expression 6.

$$PI'[w] = PI[w] * FW[w] \quad \text{[Expression 6]}$$

As described above, the signal processor 130 shown in FIG. 15 may obtain an output channel signal rendered by applying the frequency conversion, the re-panning, the room gain control, the inverse frequency conversion, etc., to an input channel signal. However, considerable redundancy is present in the left and right input channel signals. Such redundancy may also be regarded as similarity or correlation.

For example, when a user listens to a sound while watching an image in front of a TV and the sound is a human voice, an auditory image of the voice should be formed in front of the TV. This is because a sound is more naturally provided when a direction of a TV image is matched with a direction of a voice component in the TV image. For this matching, about 70% of the voice component is typically distributed to each of the left channel and the right channel. In this case, components other than a common component, i.e., uncommon components La and Ra, are subjected to various audio effects (e.g., the sound field effect, the panning effect, etc.) and matched with the position of the TV image in order to achieve a realistic sound. Actually, the TV supports various sound modes for an audio option to make such audio effects.

However, when such common components are included in two channel signals and subjected to the panning, is the result is unnatural since a human voice is spread leftward and rightward with respect to the median plane. Accordingly, as according to another embodiment (or a modification to the embodiment of FIG. 15), only non-common components (e.g., an ambient signal) other than common components between two channel signals are input to the re-panner 140 and subjected to the re-panning.

Figure 27:
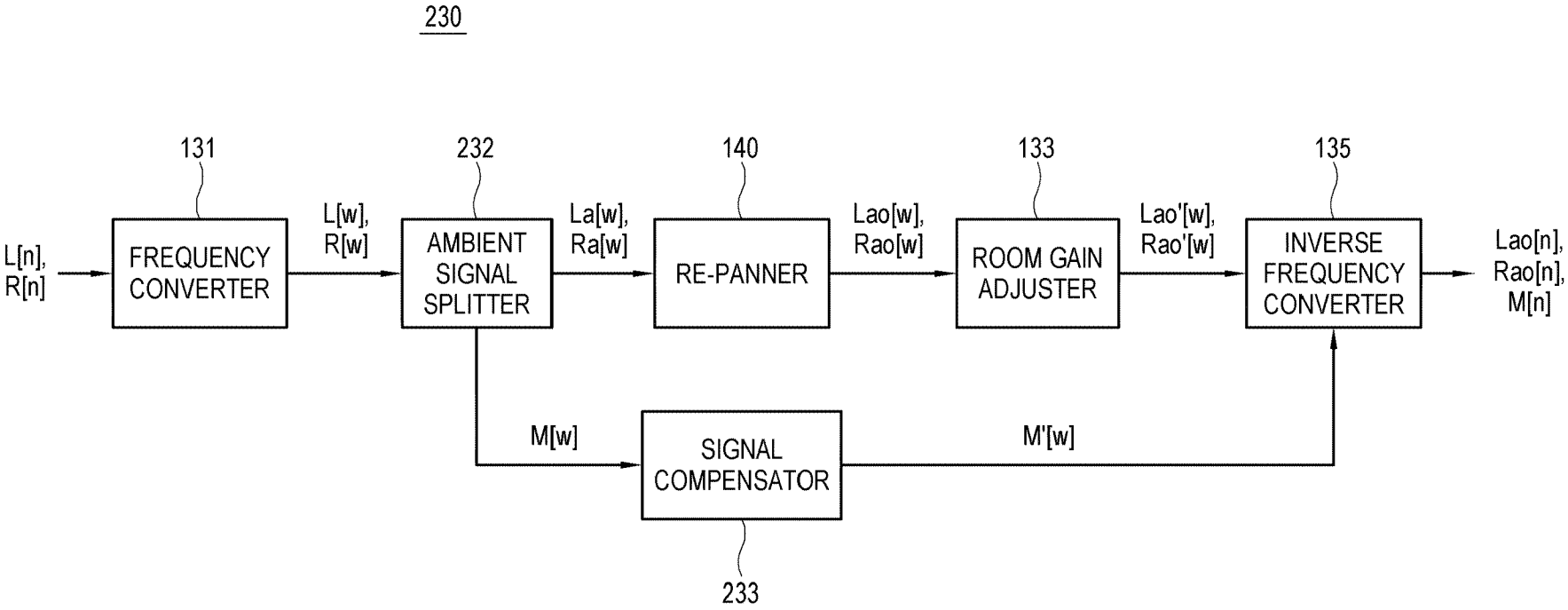
FIG. 27 is a block diagram illustrating a configuration of a signal processor according to an embodiment.

FIG. 27 is a block diagram illustrating a configuration of a signal processor 230 according to an another embodiment. A signal processor 230 may be materialized or embodied by an integrated circuit such as a DSP, but is not limited thereto in various other embodiments. Alternatively, the signal processor 230 may be achieved or implemented by a software program or computer code that is loaded into a system memory and executed by the processor 10.

Here, the signal processor 230 may include the frequency converter 131, an ambient signal splitter 232, the re-panner 140, the room gain controller 133, the inverse frequency converter 135, and a signal compensator 233. According to one or more other embodiments, at least one of the room gain controller 133, the inverse frequency converter 135, and a signal compensator 233 may be omitted. Here, the configuration and operations of the frequency converter 131, the re-panner 140, the room gain controller 133, and the inverse frequency converter 135 are the same as or similar to those described above with reference to FIG. 15, and thus redundant descriptions will be omitted below.

First, the frequency converter 131 converts signals of two or more channels from the channel processor 110 through frequency conversion, thereby generating a channel signal of a frequency domain.

The ambient signal splitter 232 extracts an ambient signal by removing the common components between the left channel signal and the right channel signal from the channel signal of the frequency domain. To remove the common components, the ambient signal splitter 232 calculates a correlation between the left channel signal and the right channel signal according to the frequency bands.

For example, the correlation is calculated by the following Expression 7.

$$Coh_{LR}[w] = \frac{|G_{LR}[w]|^2}{G_{LL}[w]G_{RR}[w]} \quad \text{[Expression 7]}$$

where $G_{LR}[w]$ is a cross-spectral density between a left channel L and a right channel R, and $G_{LL}[w]$ and $G_{RR}[w]$ are auto-spectral densities of the left channel L and the right channel R, respectively. The correlation $Coh_{LR}[w]$ has a value ranging from 0 to 1. The details of the correlation are described in "Random Data" published in 1971 by "J. S. Bendat" et al.

As an alternative method of extracting the common components, similarity may be used instead of the correlation or together with the correlation. The details of the similarity is described in A Frequency-Domain Approach to Multichannel Upmix" published in 2004 by "C. Avendano" et al.

According to an embodiment, the signal processor 230 may calculate the common component M[w] by the following Expression 8.

$$M[w] = Coh[w] * Sim[w] * \frac{L[w] + R[w]}{2} \quad \text{[Expression 8]}$$

where Coh[w] is a correlation in a specific frequency band, and Sim[w] is a similarity in the frequency band. By multiplying Coh[w] and Sim[w], unique components thereof may be involved in the common component M[w]. Alternatively, without limitations, only one of Coh[w] and Sim [w] in the Expression 8 may be employed in various other embodiments.

The ambient signal splitter 232 obtains the common component M[w] by multiplying the product of the correlation and the similarity with an average of the left channel signal L[w] and the right channel signal R[w]. In this manner, when the common component is obtained, the ambient signals La[w] and Ra[w] of the left and right channels may be defined by the following Expression 9.

$$La[w]=L[w]-M[w]$$

$$Ra[w]=R[w]-M[w] \quad \text{[Expression 9]}$$

The ambient signals obtained as above, i.e., La[w] and Ra[w] are input to the re-panner 140. The re-panning performed in the re-panner 140 and the room gain control performed in the room gain controller 133 are the same as or similar to those described above except that the input signals L[w] and R[w] are replaced by the ambient signals La[w] and Ra[w]. Thus, redundant descriptions are omitted below.

Meanwhile, the common component signal M[w] obtained in the ambient signal splitter 232 is input not to the re-panner 140, but an additional signal compensator 233. The signal compensator 233 applies compensation and various types of filtering to the common component signal.

The inverse frequency converter 135 receives an output from the room gain controller 133 or an output from the re-panner 140 when the room gain control is omitted, and applies the inverse frequency conversion to the output, thereby providing result signals $La_o[n]$ and $Ra_o[n]$ to the signal distributor 150. The result signals $La_o[n]$ and $Ra_o[n]$ are converted into audible sounds by the directional speakers 30-1 and 30-2 via the signal distributor 150. Meanwhile, the common signal M'[w] compensated and filtered in the signal compensator 233 is subjected to the inverse frequency conversion by the inverse frequency converter 135 since the common signal M'[w] is also the signal of the frequency domain, and then provided as a signal M[n] of the time domain to the signal distributor 150. Ultimately, the common component signal M[n] is converted to have an audible frequency through the directional speakers 30-1 and 30-2 or the omnidirectional speakers 30-3 and 30-4.

The elements shown in FIGS. 2, 15, 17 and 27 may be materialized or implemented by a task, a class, a subroutine, a process, an object, an execution thread, a program or the like software implemented in a predetermined area of a memory; a field-programmable gate array (FPGA), an application-specific integrated circuit (ASIC) or the like hardware; or a combination of software and hardware. The elements may be implemented or embodied in a computer-readable storage medium, or partially divided and distributed to a plurality of computers.

Further, each block may depict a part of a module, a segment or a code, which includes one or more executable instructions for implementing a specific logic function(s). Further, according one or more other embodiments, the functions mentioned in or described with reference to the blocks may be implemented in any sequence. For example, two blocks illustrated in succession may actually be performed at substantially the same time, or may be performed in reverse order according to their corresponding functions.

Figure 28:
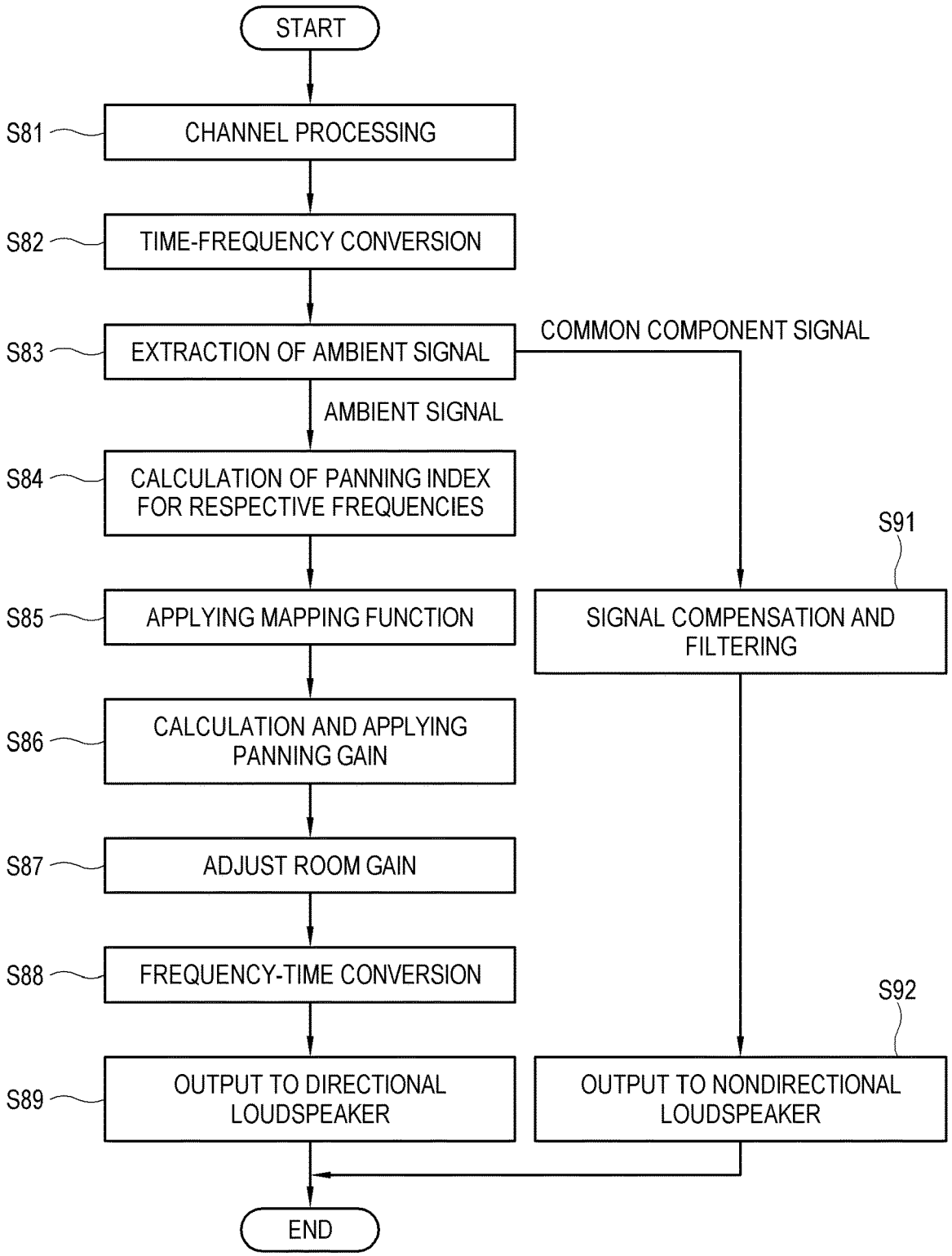
FIG. 28 is a flowchart of an audio signal processing method according to an embodiment.

FIG. 28 is a flowchart of an audio signal processing method according to an embodiment.

Referring to FIG. 28, the channel processor 110 determines whether the number of channels in given audio data corresponds to the number of speaker devices 30*a*, 30*b* and 30*n*, and performs channel mapping accordingly (operation S81). The channel processor 110 may perform up-mixing or down-mixing to adjust the number of channels.

The frequency converter 131 converts two or more channel signals (i.e., multi-channel signals) generated in the channel processor 110 by time-frequency conversion, thereby generating a channel signal of the frequency domain (operation S82). For such time-frequency conversion, the DFT, the FFT, the DCT, the DST, etc., may be used.

The ambient signal splitter 232 splits a common component between the left channel signal and the right channel signal from the converted channel signal of the frequency domain (operation S83). To extract the common component, the ambient signal splitter 232 calculates a correlation between the left channel signal and the right channel signal according to the frequency bands. The ambient signal splitter 232 generates the ambient signal of two channels by subtracting the common component from each converted channel signal.

The ambient signal is input to the panning index calculator 141. The panning index calculator 141 calculates the panning index according to the frequency bands on the basis of a level ratio between the left and right channel signals of the ambient signal (operation S84).

The mapping section 142 adjusts the panning index by applying the mapping function f(x) to the panning index PI calculated in the panning index calculator 141, and then provides the adjusted panning index to the panning gain calculator 143 (operation S85). Here, the mapping function may amplify or reduce a difference between the left and right channel signals in a specific frequency band (w). In one or more other embodiments, the mapping function may be omitted.

The panning gain calculator 143 calculates a channel gain changed or adjusted for the left channel signal and a channel gain changed or adjusted for the right channel signal by applying a specific panning scheme to the panning index, and provides the changed channel gains to the panning gain controller 144 (operation S86). In this case, the panning gain controller 144 multiplies two channel signals included in the ambient signal with the changed channel gains, and outputs the results (operation S86).

The room gain controller 133 controls the room gain by applying different room gains or parameter EQs according to the frequency bands before applying the inverse frequency conversion to the channel signals as a whole (operation S87). In one or more other embodiments, the room gain control may be omitted.

The inverse frequency converter 135 applies the inverse frequency conversion to the provided channel signal or channel level and thus restores a channel signal of a time domain (operation S88). The channel signal of the time domain is output to the directional speakers 30-1 and 30-2 via the signal distributor 150 (operation S89).

Meanwhile, the common component signal split by the ambient signal splitter 232 is input to the signal compensator 233, and the signal compensator 233 performs compensation and various kinds of filtering on the common component signal (operation S91). Such a compensated and filtered common component signal is subjected to the inverse frequency conversion, and then output to the omnidirectional speakers 30-3 and 30-4 (operation S92), and/or the directional speakers 30-1 and 30-2.

Figure 29:
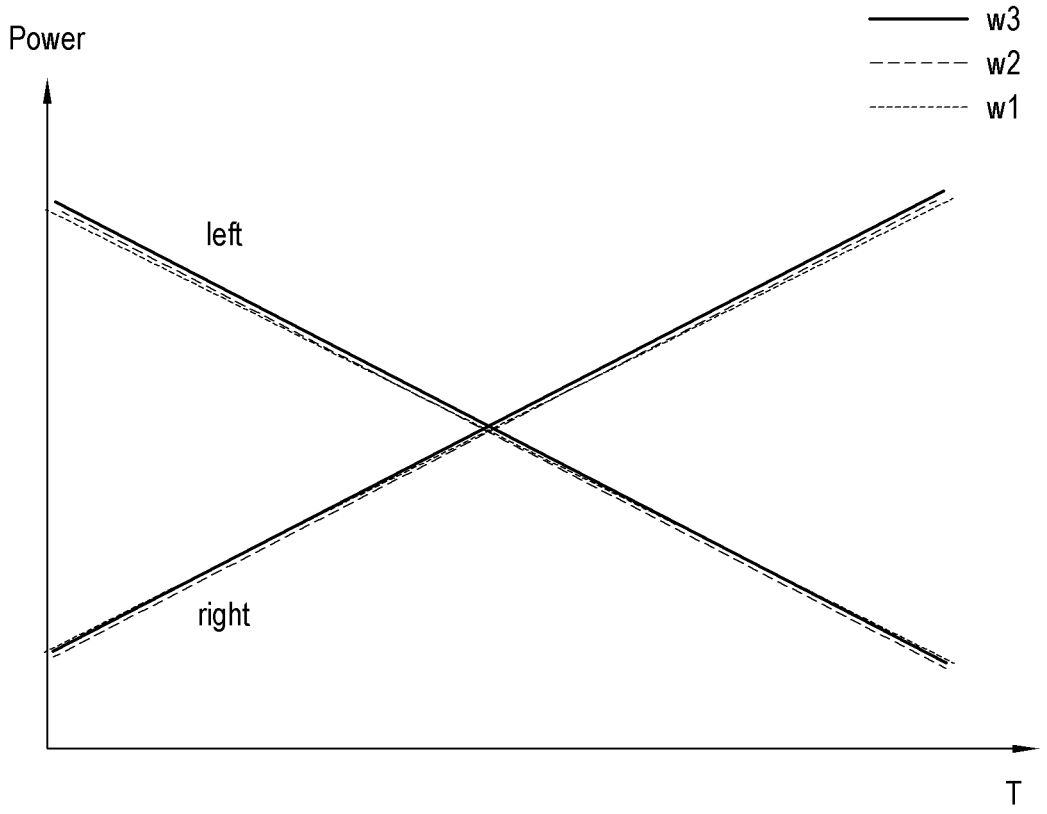
FIGS. 29 and 30 are a frequency-band power graph of when a re-panning process according to an embodiment is performed, and a frequency-band power graph of when the re-panning process is not performed.
Figure 30:
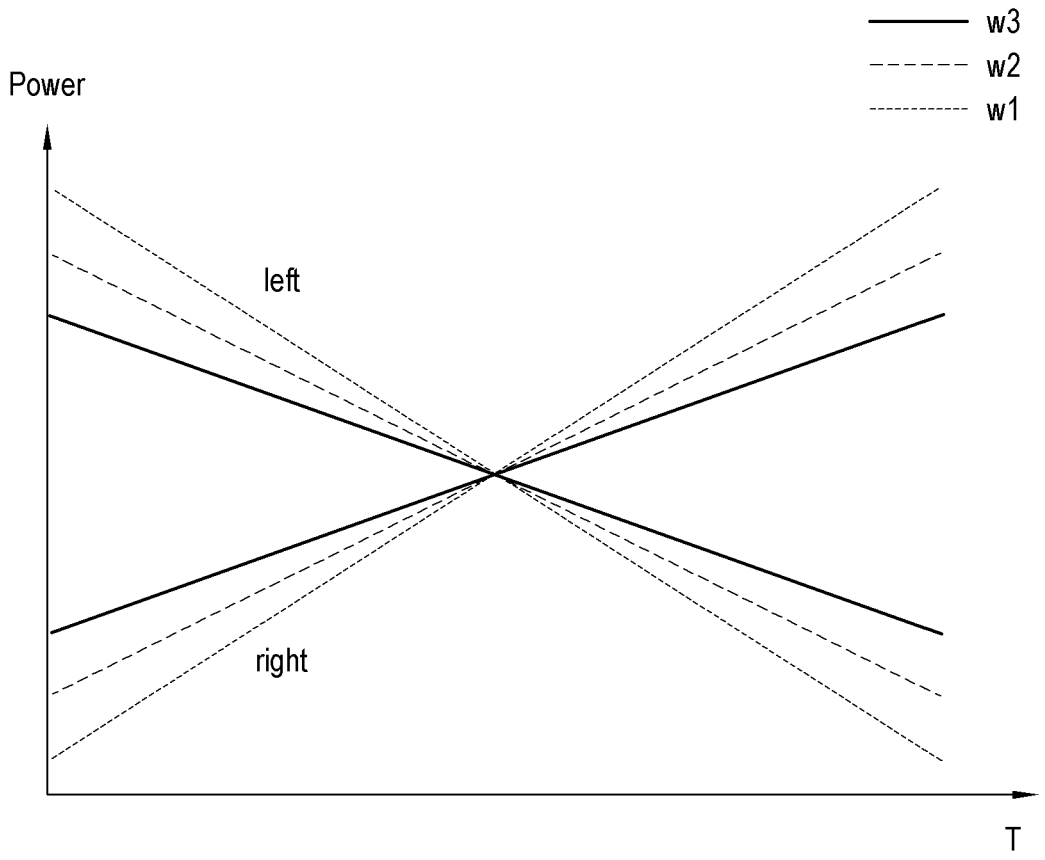

FIG. 29 illustrates a frequency-band power graph of when a re-panning process according to an embodiment is performed, and FIG. 30 illustrates a frequency-band power graph of when the re-panning process is not performed. In these graphs, the axis of abscissae indicates time, and the axis of ordinates indicates the frequency band power. Further, in the present examples, the frequencies w1, w2, w3 are provided to satisfy a condition of w3>w2>w1.

Here, a white noise signal, which has been subjected to bandpass filtering according to frequency bands, is used as a test signal. While changing the test signal in an auditory image from −90 degrees to +90 degrees in the present example, power change was measured through a dummy head with regard to the left channel and the right channel.

First, referring to FIG. 29, as time progresses, the gain (or power) of the left channel linearly decreases and the gain (or power) of the right channel linearly increases. However, such graph patterns are matched and provided regardless of the frequency band (w) of the frequency component the test signal has. Since the power is constant regardless of frequency change, the auditory image may be for example bisected as shown in FIG. 13.

Next, referring to FIG. 30, as time progresses, the level (or power) of the left channel linearly decreases and the gain (or power) of the right channel linearly increases, and at the same time the gain (or power) is varied depending on the frequency band. Here, the increasing width (i.e., adjustment value) of the gain (or power) of the left and right channels becomes larger as the frequency of the corresponding channel signal decreases in the order of w3, w2 and w1. Therefore, the adjustment value of the gain (or power) becomes greater as the frequency decreases at a certain position of the auditory image, thereby having an effect of eliminating the separation phenomenon of the auditory image as shown in FIG. 14, by way of example.

As described above, the audio signal processing device 50 according to an embodiment, the audio signal output apparatus 100 including the audio signal processing device 50, and the display apparatus 200 including the audio signal output apparatus 100 and the display panel have been described. Further, the directional speakers 30-1 and 30-2 according to an embodiment, to be mounted to the audio signal output apparatus 100 or the display apparatus 200, have been described.

It is understood that the re-panning process in the audio signal processing device 50 illustrated in FIG. 15 or 24 according to one or more other embodiments may not always be applied to only the foregoing directional speakers 30-1 and 30-2. Because the auditory image is likely to be separated according to the frequencies when the sound wave is reflected from the wall or ceiling due to the characteristics of the directional speaker that intensively emanates the sound wave in a specific direction, the re-panning may be applied to other directional speakers.

Figure 31:
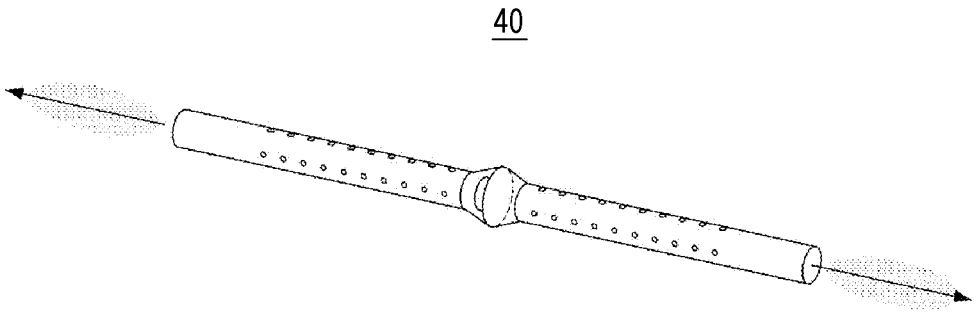
FIGS. 31 to 33 are views illustrating examples of various related art directional loudspeakers.
Figure 32:
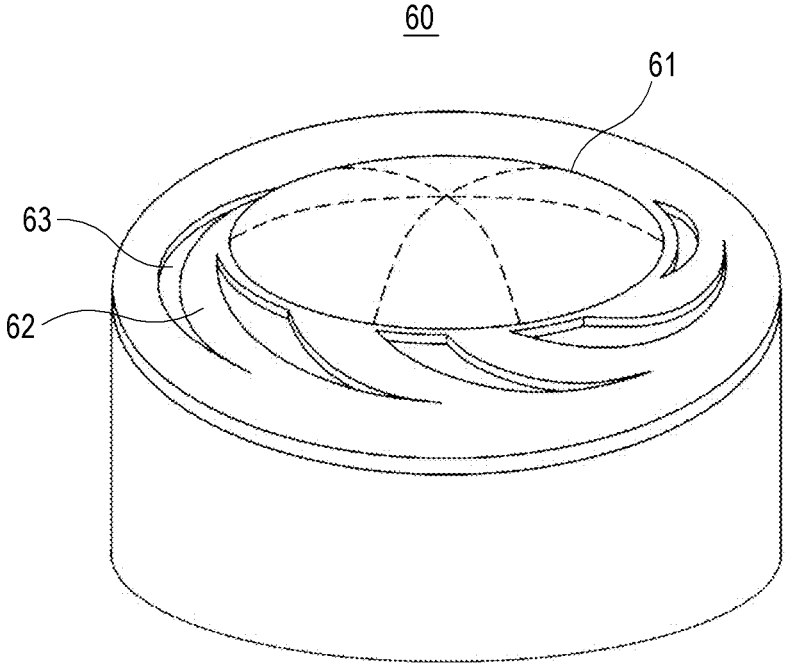
Figure 33:
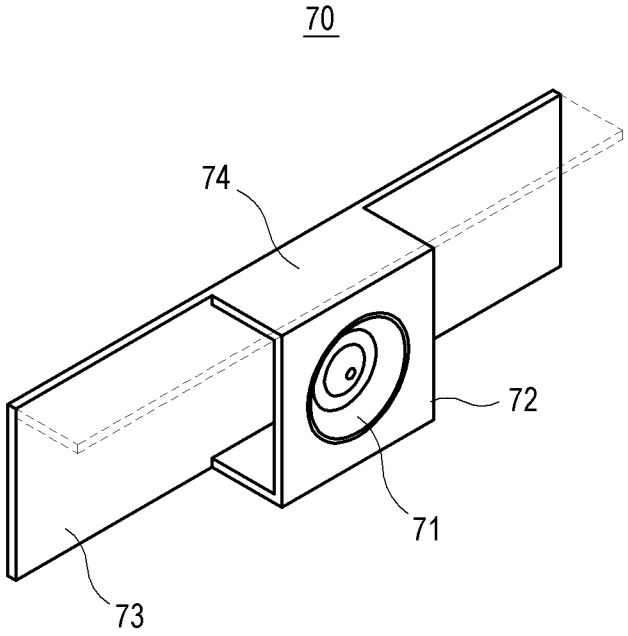

FIGS. 31 to 33 are views illustrating various related art directional speakers. A directional speaker 40 of FIG. 31 has the same structure of an end-fire radiator as the directional speaker 30-1 shown in FIG. 5, and includes a plurality of through holes in the body thereof. However, the directional speaker 40 is characterized in that the sound wave longitudinally emanates in opposite directions, and the sound maker (i.e., driver) is provided at the center of a bilateral symmetric shape.

A directional speaker 60 of FIG. 32 is driven by a piezoelectric device. The directional speaker 60 includes a vibrating plate 62 having a slit opening 63, and a piezoelectric device 61 formed on the top of the vibrating plate 62. The directional speaker 60 makes an ultrasonic carrier wave overlap with an audible sound, and inputs the overlapped carrier wave to the piezoelectric device, thereby vibrating the vibrating plate 62 to generate a sound wave.

Further, a directional speaker 70 of FIG. 33 is a dome-type speaker, which includes an acoustic transducer 71, a reflection plate 73 placed behind the acoustic transducer 71, a baffle 72 for isolating a front side and a rear side of the acoustic transducer 71, and a roof plate 74 connecting the reflection plate 73 and the acoustic transducer 71.

As shown in FIGS. 31 to 33, various types of directional speakers are proposed. According to an embodiment, instead of the directional speakers 30-1 and 30-2, such directional speakers may be mounted to the audio signal output apparatus 100 or the display apparatus 200 and undergo the foregoing re-panning process in order to reduce the separation phenomenon of the auditory image caused by the characteristics of the directionality. However, a voice and the like low frequency signal may be inconvenient to a user when it is subjected to the re-panning, and therefore the signal of a certain frequency or lower may be bandpass-filtered and output to other omnidirectional speakers.

According to one or more embodiments, without establishing a traditional home-theater system, the directional speaker and the omnidirectional speaker are properly arranged in the audio signal output apparatus or the display apparatus, and a signal input to the speakers is rendered suitably for the arrangement, thereby sufficiently providing a realistic sound and a sound field within a restricted indoor environment.

Further, the separation phenomenon of the auditory image, which occurs when the directional speakers arranged on the back of the display apparatus are used, is eliminated by the re-panning process, thereby providing a more natural sound and enhanced sound quality to a user.

Although certain embodiments have been shown and described, it will be appreciated by a person having an ordinary skill in the art, to which the present disclosure pertains, that alternative embodiments may be made without changing the technical concept or essential features. Therefore, it will be understood that the foregoing embodiments are for not restrictive but illustrative purposes only in all aspects.

What is claimed is:

1. An apparatus for outputting an audio signal, the apparatus comprising:

a channel processor configured to generate two or more channel signals from audio data;

a signal processor configured to render the generated two or more channel signals; and a directional speaker configured to reproduce a rendered channel signal, among the rendered two or more channel signals, as audible sound, wherein the signal processor comprises:

a frequency converter configured to generate channel signals of a frequency domain by converting the generated two or more channel signals through frequency conversion; and a re-panner configured to change, by as much as an adjustment value for a channel gain, the channel gain of at least one channel signal of the generated channel signals of the frequency domain, wherein the adjustment value is determined so that a position difference between a first auditory image and a second auditory image of the at least one channel signal decreases, a frequency band of the second auditory image being higher than a frequency band of the first auditory image.

2. The apparatus according to claim 1, wherein the signal processor further comprises an inverse frequency converter configured to restore a channel signal of a time domain by applying inverse frequency conversion to the at least one channel signal having the changed channel gain.

3. The apparatus according to claim 2, wherein the signal processor further comprises a room gain adjuster configured to apply different room gains to respective frequency bands before applying the inverse frequency conversion to the at least one channel signal having the changed channel gain.

4. The apparatus according to claim 1, wherein the adjustment value decreases as a frequency of the at least one channel signal of the generated channel signals of the frequency domain increases.

5. The apparatus according to claim 4, wherein:

the adjustment value is applied to change a channel gain of a left channel signal and to change a channel gain of a right channel signal, of the generated channel signals of the frequency domain; and a sum or a sum of squares of the changed channel gain of the left channel signal and the changed channel gain of the right channel signal is kept constant.

6. The apparatus according to claim 4, wherein the re-panner comprises:

a panning index calculator configured to calculate a panning index for respective frequency bands based on a level ratio between a left channel signal and a right channel signal, of the generated channel signals of the frequency domain;

a panning gain calculator configured to calculate a channel gain for the left channel signal and a channel gain for the right channel signal by applying a panning scheme to the panning index; and a panning gain adjuster configured to apply the calculated channel gain for the left channel signal to the left channel signal, and to apply the calculated channel gain for the right channel signal to the right channel signal.

7. The apparatus according to claim 6, wherein the re-panner further comprises a mapping section configured to adjust the calculated panel index and to provide the adjusted panel index to the panning gain adjuster.

8. The apparatus according to claim 6, wherein the re-panner further comprises a frequency weighting section configured to apply a frequency weight to the calculated panning index and provide the panning index, to which the frequency weight has been applied, to the panning gain adjuster, so as to reduce a panning effect in a specific frequency band or higher.

9. The apparatus according to claim 8, wherein the applied frequency weight comprises a low frequency region in which a first level is constant, a high frequency region in which a second level lower than the first level is constant, and a transition region in which a transition is made from the first level to the second level between the low frequency region and the high frequency region.

10. The apparatus according to claim 6, wherein:

the signal processor further comprises an ambient signal splitter configured to extract an ambient signal by removing a common component between the left channel signal and the right channel signal from the generated channel signals of the frequency domain; and the re-panner is configured to change a channel gain of the extracted ambient signal, at least partially, by as much as the adjustment value.

11. The apparatus according to claim 1, wherein a position of an auditory image formed by an output of the audible sound includes at least a position of the first auditory image and a position of the second auditory image, the position of the second auditory image being more distant than the position of the first auditory image with respect to a median plane.

12. The apparatus according to claim 11, wherein the at least one channel signal of the generated channel signals of the frequency domain comprise a channel signal between a lowest frequency and a highest frequency among frequencies of the audible sound output to the position of the second auditory image.

13. The apparatus according to claim 1, further comprising an external housing comprising a front side on which a display panel is provided;

wherein the external housing accommodates the channel processor, the signal processor and the directional speaker, and wherein the directional speaker is of two or more channels and is provided on at least one of a back side opposite to the front side of the external housing, a top side of the external housing, or a lateral side of the external housing, and is configured to convert the rendered two or more channel signals into the audible sound and to output the audible sound in a predetermined direction.

14. The apparatus according to claim 13, further comprising:

non-directional speakers of two or more channels, provided on at least one of the front side or a bottom side of the external housing, wherein the directional speaker of the two or more channels is a surround channel speaker, and the non-directional speakers for the two or more channels are front channel speakers, and wherein a channel signal of a frequency band lower than a frequency of the audible sound output from the directional speaker is bandpass-filtered for the non-directional speakers.

15. The apparatus according to claim 14, further comprising an ambient signal splitter configured to extract an ambient signal by removing a common component between a left channel signal and a right channel signal from the generated channel signals of the frequency domain; and the re-panner is configured to change a channel gain of the extracted ambient signal, at least partially, as much as the adjustment value.

16. A method of outputting an audio signal, which is performed by at least one processor to reproduce and output an audible sound from audio data, the method comprising:

generating two or more channel signals from the audio data;

generating channel signals of a frequency domain by converting the generated two or more channel signals through frequency conversion;

changing, by as much as an adjustment value for a channel gain, the channel gain of at least one channel signal of the generated channel signals of the frequency domain; and reproducing, as audible sound, the at least one channel signal having the changed channel gain, wherein the adjustment value is determined so that a position difference between a first auditory image and a second auditory image of the at least one channel signal decreases, a frequency band of the second auditory image being higher than a frequency band of the first auditory image.

17. The method according to claim 16, wherein the adjustment value decreases as a frequency of the at least one channel signal of the generated channel signals of the frequency domain increases.

18. The method according to claim 16, further comprising restoring a channel signal of a time domain by applying inverse frequency conversion to the at least one channel signal having the changed channel gain.

19. The method according to claim 18, further comprising applying different room gains to respective frequency bands before applying the inverse frequency conversion to the at least one channel signal having the changed channel gain.

20. The method according to claim 16, further comprising:

extracting an ambient signal by removing a common component between a left channel signal and a right channel signal from the generated channel signals of the frequency domain, wherein changing the channel gain comprises changing a channel gain of the ambient signal, at least partially, by as much as the adjustment value.

* * * * *